US007836812B2

(12) United States Patent
Spork et al.

(10) Patent No.: US 7,836,812 B2
(45) Date of Patent: Nov. 23, 2010

(54) PROPELLANT CHARGE FEED OR SUPPLY MEANS

(75) Inventors: Roland Spork, Petersberg (DE); Georg Scheidemann, Udenborn (DE); Siegfried Süss, Niestetal (DE); Jens Grünewald, Kassel (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 905 days.

(21) Appl. No.: 11/474,684

(22) Filed: Jun. 26, 2006

(65) Prior Publication Data

US 2007/0113732 A1 May 24, 2007

(30) Foreign Application Priority Data

Jun. 24, 2005 (DE) ..... 10 2005 029 413

(51) Int. Cl.
*F41A 9/11* (2006.01)

(52) U.S. Cl. ..... 89/45

(58) Field of Classification Search ..... 89/46, 89/47, 45, 33.05

See application file for complete search history.

(56) References Cited

U.S. PATENT DOCUMENTS

| | | | | | |
|---|---|---|---|---|---|
| 789,885 | A * | 5/1905 | Schneider | ..... | 89/47 |
| 1,310,890 | A * | 7/1919 | Schneider | ..... | 89/45 |
| 1,326,789 | A * | 12/1919 | Schneider | ..... | 89/47 |
| 3,938,421 | A | 2/1976 | Nordmann | | |
| 4,135,433 | A * | 1/1979 | Hultgren et al. | ..... | 89/47 |
| 4,727,790 | A * | 3/1988 | DeHaven et al. | ..... | 89/46 |
| 5,111,731 | A * | 5/1992 | Grabner | ..... | 89/46 |
| 5,168,121 | A | 12/1992 | Maynard | | |
| 5,196,643 | A * | 3/1993 | Jorg et al. | ..... | 89/46 |
| 5,773,747 | A * | 6/1998 | Tellander et al. | ..... | 89/47 |
| 5,831,201 | A * | 11/1998 | Andersson et al. | ..... | 89/45 |
| 5,837,923 | A * | 11/1998 | Gay et al. | ..... | 89/46 |
| 5,844,163 | A * | 12/1998 | Lindskog | ..... | 89/46 |
| 6,026,729 | A * | 2/2000 | Hallqvist | ..... | 89/46 |
| 6,772,669 | B1 | 8/2004 | Stalhandske et al. | | |
| 7,159,504 | B2 * | 1/2007 | Heldmann et al. | ..... | 89/45 |
| 2006/0236852 | A1 * | 10/2006 | Joubert | ..... | 89/45 |

* cited by examiner

*Primary Examiner*—Michael Carone
*Assistant Examiner*—Reginald Tillman, Jr.
(74) *Attorney, Agent, or Firm*—Robert W. Becker & Assoc.; Robert Becker

(57) ABSTRACT

A propellant charge feed or supply system for automatic introduction of modular propellant charges into the weapon tube of a heavy weapon having a breech assembly and a propellant charge chamber in front of the breech assembly. An oblong propellant charge feed tray is pivotable into position behind the weapon tube such that propellant charges disposed on the propellant charge feed tray are disposed coaxial relative to the axis of the bore of the weapon tube. A providing device is adapted during a feed stroke to move the propellant feed tray into the breech assembly up to the propellant charge chamber. An introduction device is adapted during an introduction stroke to move the propellant charges from the feed tray into the propellant charge feed tray.

15 Claims, 22 Drawing Sheets

PROPELLANT CHARGE FEED OR SUPPLY MEANS

BACKGROUND OF THE INVENTION

The present invention relates to a propellant charge feed or supply means.

The propellant charge feed means is a part of a fully automatic firing module on a combat vehicle having a heavy weapon.

A fully automatic firing module has several advantages in comparison with a firing module that has to be operated manually. For example, the automation enables the personnel that operate the weapon to be spatially separated from the weapon, the aiming mechanism, the projectile feed means, the propellant charge feed means and the ammunition. The existing structure for ballistic protection can hence be reduced to the space of the protective compartment for the personnel, in other words, the control station. By separating the operating personnel and the firing module, the number of crewmembers can be reduced to a minimum. Furthermore, the total weight of the combat vehicle can be reduced. The separation of the personnel and the firing module further enables new concepts of loading since the space, which was before kept empty for the personnel operating the weapon, can now be utilized. With a fully automatic firing module, a secure introduction of the propellant charge is possible at any imaginable angle of elevation of the weapon. A fully automatic firing module furthermore has the advantage that a wrong operation caused by human mistakes can be prevented.

A fully automatic firing module is described in DE 10258263 A1. The firing module described therein has a housing that is mountable on a support structure so as to be pivotable in the azimuth. A heavy weapon is arranged in the housing so that its angle of elevation can be changed by swiveling it about a trunnion. On the one hand, the weapon is supplied with projectiles from a projectile magazine by a fully automatic projectile providing means. On the other hand, a fully automatic propellant charge feed means that is located in the housing supplies propellant charges from a propellant charge magazine. The propellant charge feed means has a propellant charge feed tray with a propellant charge introducing means, which can be pivoted into the space behind the weapon, aligned with the axis of the bore of the weapon.

It is a disadvantage of the aforementioned configuration that the propellant charge introducing means, which can e.g. be configured as a chain that is stiff on top, does not guarantee a precise introduction of the propellant charge into an intended introduction position in a propellant charge chamber of a weapon tube. The intended introduction position is important for the optimal detonation of the propellant charge and hence for the firing of the projectile. During the automated process of detonation, a primer detonates the propellant charge charges from behind. For an optimal detonation, the propellant charges hereby have to be located in an intended position. Since the weapon tube is often raised in elevation, it has to be ensured that the propellant charge charges do not slide backwards and out of the weapon tube. That is realized by means of a base ring. Hence, the propellant charges have to be moved by the propellant charge feed means—as accurately as possible—until they are located precisely behind the base ring.

The precise, automatic introduction of the propellant charges into an intended introduction position in the propellant charge chamber of a weapon tube is an object of the present invention.

The object of the invention is realized by means of a propellant charge feed means for the automatic introduction of modular propellant charges into the weapon tube of a heavy weapon having a breech assembly and a propellant charge chamber disposed in front of the breech assembly, wherein an oblong propellant charge feed tray is pivotable into a position behind the weapon tube in such a way that the propellant charges that are disposed on the feed tray are disposed coaxial relative to the bore of the weapon tube, wherein a providing means is adapted during a feed stroke to move the propellant charge feed tray into the breech assembly up to the propellant charge chamber, and wherein an introduction means is adapted during an introduction stroke to move the propellant charges from the feed tray and into the propellant charge chamber.

Pursuant to a method of operating a propellant charge feed means for the automatic feed of modular propellant charges into a weapon tube of a heavy weapon, a propellant charge feed tray is pivoted into position behind the weapon tube in such a way that the propellant charges disposed on the feed tray are disposed coaxial relative to the axis of the bore of the weapon tube, during a feed stroke the feed tray is moved, via a providing means, into the breach assembly until reaching the propellant charge chamber, and during an introduction stroke the propellant charges are moved, via an introduction means, from the feed tray and into the propellant charge chamber.

It is the fundamental concept of the invention to divide, with the aid of the providing means and the introducing means, the sequence of movement of the propellant charges into the propellant charge chamber in two sections. The providing means hereby realize the feed stroke. In the process of the feed stroke, the propellant charge feed tray, which has at this time been pivoted into a position behind the axis of the bore of the weapon tube, is moved into the breech assembly until reaching the propellant charge chamber. The introduction means realize the introduction stroke. During the introduction stroke, the propellant charges are moved from the propellant charge feed tray and into the propellant charge chamber until reaching an intended introduction position.

In an advantageous manner, the introducing means can initiate the introduction stroke at a later time than the providing means initiate the feed stroke. Alternatively, the introducing means can perform the introduction stroke after the feed stroke performed by the providing means has been accomplished.

In an advantageous way, the introduction means can furthermore comprise a propellant charge advancing means, which is arranged in an introduction position behind the propellant charge in such a way that it can apply a force onto the propellant charges, whereby the force acts in the axial direction of the propellant charge feed tray and in the direction towards the propellant charge chamber. Hereby, the propellant charge advancing means can change from a resting position to an introduction position. This is advantageous since the space inside the combat vehicle is limited.

In an advantageous way, the introducing means and/or the providing means can have a drive configured with changeable parameters that is capable of performing a speed profile. It can for example be beneficial to slow down the speed of the propellant charge advancing means at the moment when it makes contact with the propellant charge. Thereafter, the movement of the propellant charge should nonetheless be realized as fast as possible until the moment in which the propellant charges are introduced, as slowly as possible, into the intended position in the propellant charge chamber.

The propellant charge advancing means can be provided, in an advantageous way, with one or more suction cups, which couple to the propellant charges by means of suction. Thus, the introduction of the propellant charges into the intended introduction position in the propellant charge chamber is ensured.

After the propellant charges have been introduced into the intended position in the propellant charge chamber, the introducing means and the providing means return to their initial position. In an advantageous way, the reverse feed stroke and the reverse introduction stroke can take place simultaneously, thus saving time.

It is particularly advantageous to monitor the functioning of the firing module via sensors. Before the propellant charges are introduced, it should hence be determined via sensors if the projectile is located in the intended projectile position in the weapon tube. It should be ensured for example that the projectile did not slide back towards the breech assembly. A sensing of the aforementioned type can be realized by means of laser beams or ultrasound, whereby it has to be taken into consideration that not all projectiles and particularly not all projectile undersides have the same shape.

After the propellant charges have been introduced, it should be verified if the propellant charges are located in the intended introduction position. The propellant charges should not lie too far in the rear of the introduction chamber, since, in that case, the closing weapon tube lock could damage them. Furthermore, if the angle of elevation is small or negative, the propellant charges could be located too far up front after the introduction, thus influencing the process of detonation in a disadvantageous way. The correct introduction position of the propellant charges can likewise be monitored by means of laser beams or ultrasound.

Further specific features of the present application will be described in detail subsequently.

BRIEF DESCRIPTION OF THE DRAWINGS

FIG. 3*f* shows the propellant charge feed means according to FIGS. 3*a* through 3*e* in a position after the introduction stroke has been performed.

DESCRIPTION OF SPECIFIC EMBODIMENTS

Figure 1A:
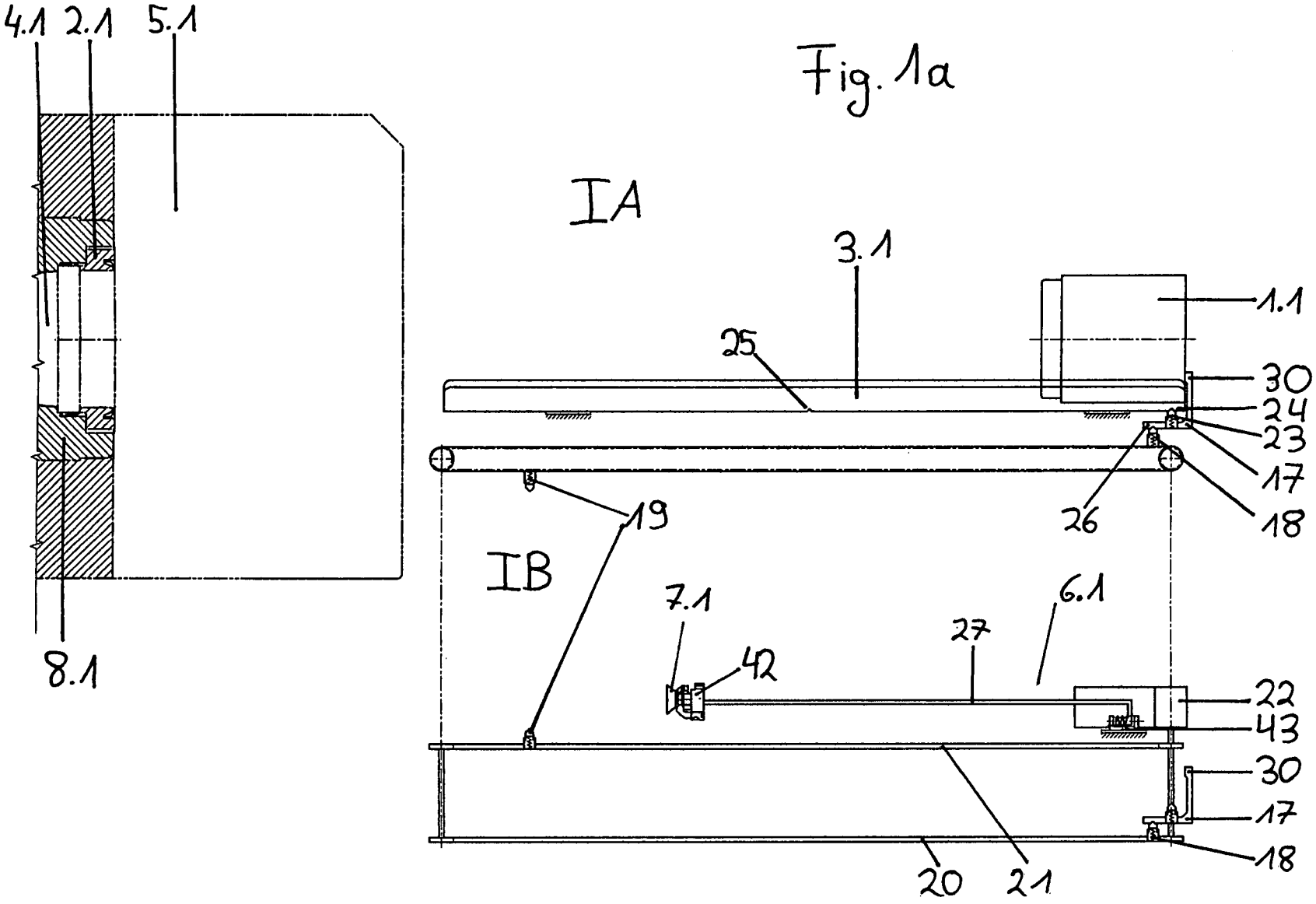
FIG. 1*a* shows a first embodiment of a propellant charge feed or supply means in a position before the feed stroke is performed.

FIGS. 1*a* through 1*e* show a first embodiment of the propellant charge feed or supply means. FIGS. 1*a* through 1*e* illustrate the sequence of introduction of the propellant charge. FIGS. 1*a* through 1*e* show the rear portion of the weapon tube 8.1, the breech assembly 5.1 and the base ring 2.1. In a side view IA, FIGS. 1*a* through 1*e* further show a propellant charge 1.1, which is located on a propellant charge feed tray 3.1, for a propellant charge module that is comprised of several individual propellant charges. Located underneath is the view IB, which is a top plan view of the view IA. Due to clarity reasons, the propellant charge 1.1 and the propellant charge feed tray 3.1 are not represented in the view IB. Likewise, not all elements that can be seen in the view IA are shown in the view IB.

The side view IA shows that the propellant charge feed tray 3.1 is pivoted into a position behind the weapon tube 8.1 in such a way that the propellant charge 1.1 is located coaxial in relation to the axis of the bore of the weapon tube 8.1. Two circumvolutory chains 20 and 21 are located underneath the propellant charge feed tray 3.1, as represented in the view IB. Both chains are driven by a rotational drive 22. An arresting part 18 is connected to the chain 20 so as to revolve with it, and an arresting part 19 is connected to the chain 21 so as to revolve with it.

The propellant charge feed tray 3.1 is provided with two engagement elements 24 and 25. The propellant charge feed tray 3.1 is connected to a carrier 17 via the engagement element 24 and an arresting part 23 that engages into the engagement element 24. The carrier 17, which has a carrier finger 30, is located behind the propellant charge 1.1 and is provided with an engagement element 26. The engagement element 26 is configured in such a way that the arresting part 18, which revolves with the chain 20, can engage into it. In the engaged state, a movement of the arresting part 18 is transferred to the carrier 17 via the engagement element 26. As long as the arresting part 23 of the carrier 17 is in engagement with the engagement element 24 of the propellant charge feed tray 3.1, the propellant charge feed tray 3.1 is likewise moved along via the carrier finger 30.

Located next to the propellant charge feed tray 3.1 is a pivotable propellant charge advancing means 6.1 comprising an introduction bar 27, an engagement element 43 and a suction cup 7.1.

The sequence of the automatic introduction of the propellant charge 1.1 into the propellant charge chamber 4.1 is explained below:

The circumvolutory chains 20 and 21 are set into motion by means of the rotational drive 22. Since the arresting part 18 is fixedly attached to the chain 20 and the arresting part 19 is fixedly attached to the chain 21, the arresting parts 18 and 19 are likewise set into motion.

Figure 1B:
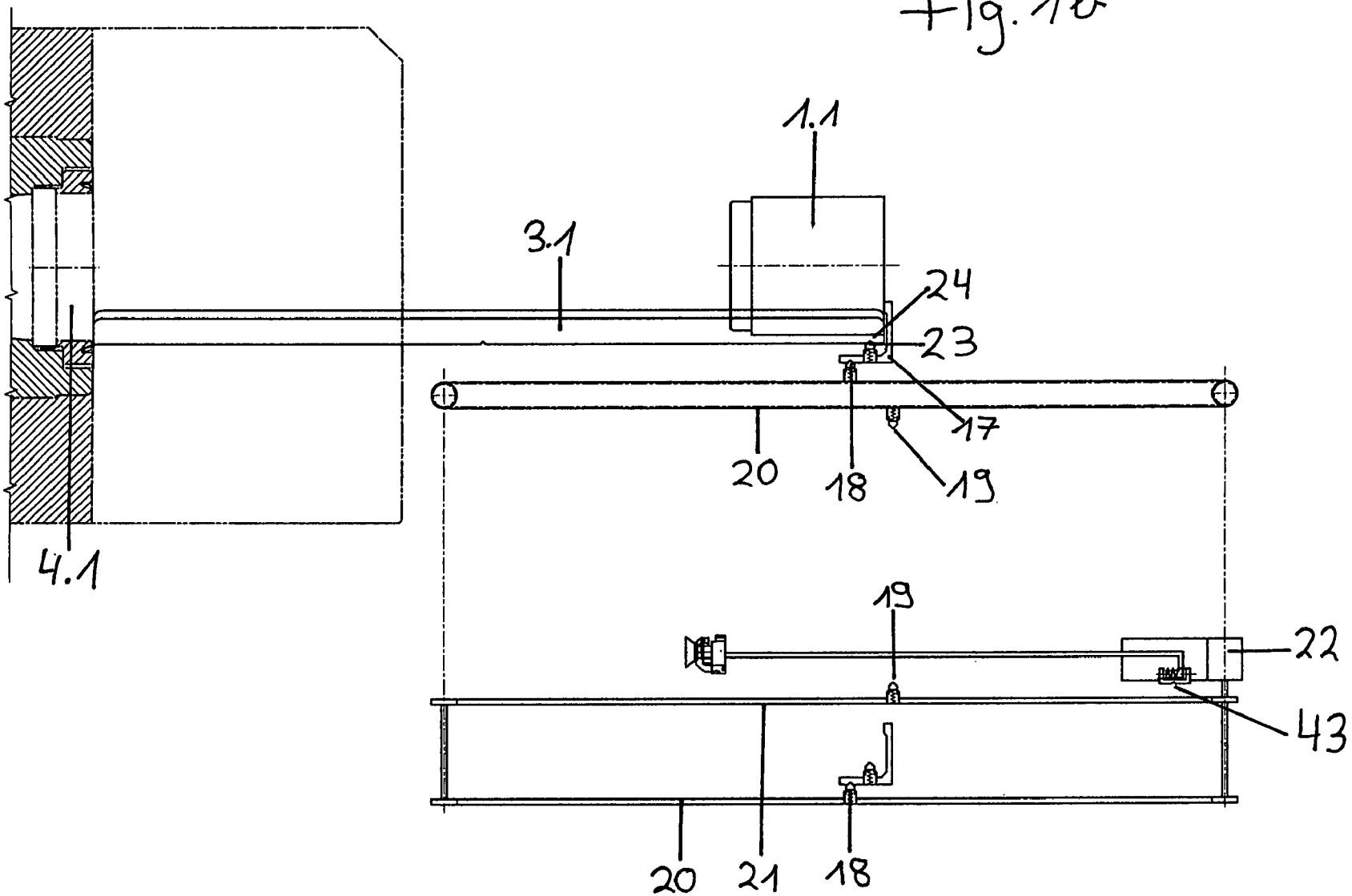
FIG. 1*b* shows the propellant charge feed means according to FIG. 1*a* in a position after the feed stroke has been performed and before the introduction stroke is performed.
Figure 1C:
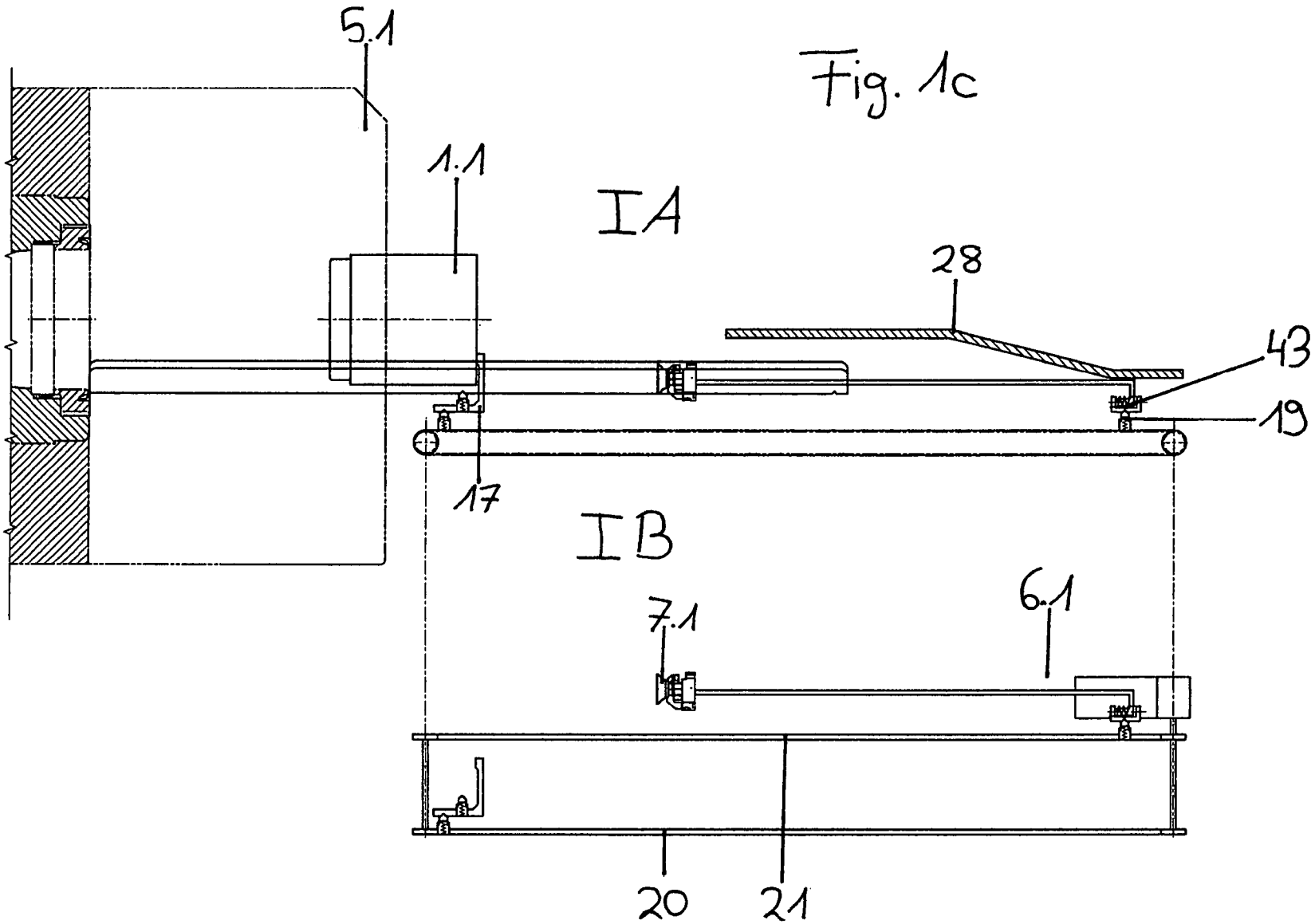
FIG. 1*c* shows the propellant charge feed means according to FIGS. 1*a* and 1*b* in a position in which the introduction stroke is being prepared.

As represented in FIG. 1*a,* the arresting part 18 engages into the engagement element 26 and the arresting part 23 engages into the engagement element 24 of the propellant charge feed tray 3.1. Hence, the propellant charge feed tray 3.1 is moved along, or in other words, the propellant charge feed tray 3.1 is moved towards the breech assembly 5.1. The propellant charge feed tray 3.1 is moved through the breech assembly 5.1 until it abuts against the propellant charge chamber 4.1. That movement represents the feed stroke. FIG. 1*b* represents the state after the feed stroke has been realized. After the propellant charge feed tray 3.1 abuts against the propellant charge chamber 4.1, it cannot be moved further in that direction. Nevertheless, the rotational drive 22 continues to drive the chains 20 and 21 and the arresting parts 18 and 19. Since the propellant charge feed tray 3.1 cannot move any further, the arresting part 23 disengages from the engagement element 24. Via the arresting part 18, the rotational drive 22 moves the carrier 17 towards the propellant charge chamber 4.1, thereby carrying with it the propellant charge 1.1 that lies on the propellant charge feed tray 3.1 without being attached to it. The carrier 17 is moved until the arresting part 23 engages into the engagement element 25. That position is represented in FIG. 1*c*. In that position, the arresting part 19 has reached the engagement element 43 of the propellant charge advancing means 6.1. For clarity reasons, the propellant charge advancing means 6.1 is also represented in the view IA of FIG. 1*c*. Likewise represented in the view IA is a guide rail 28, the function of which is explained below.

Figure 1D:
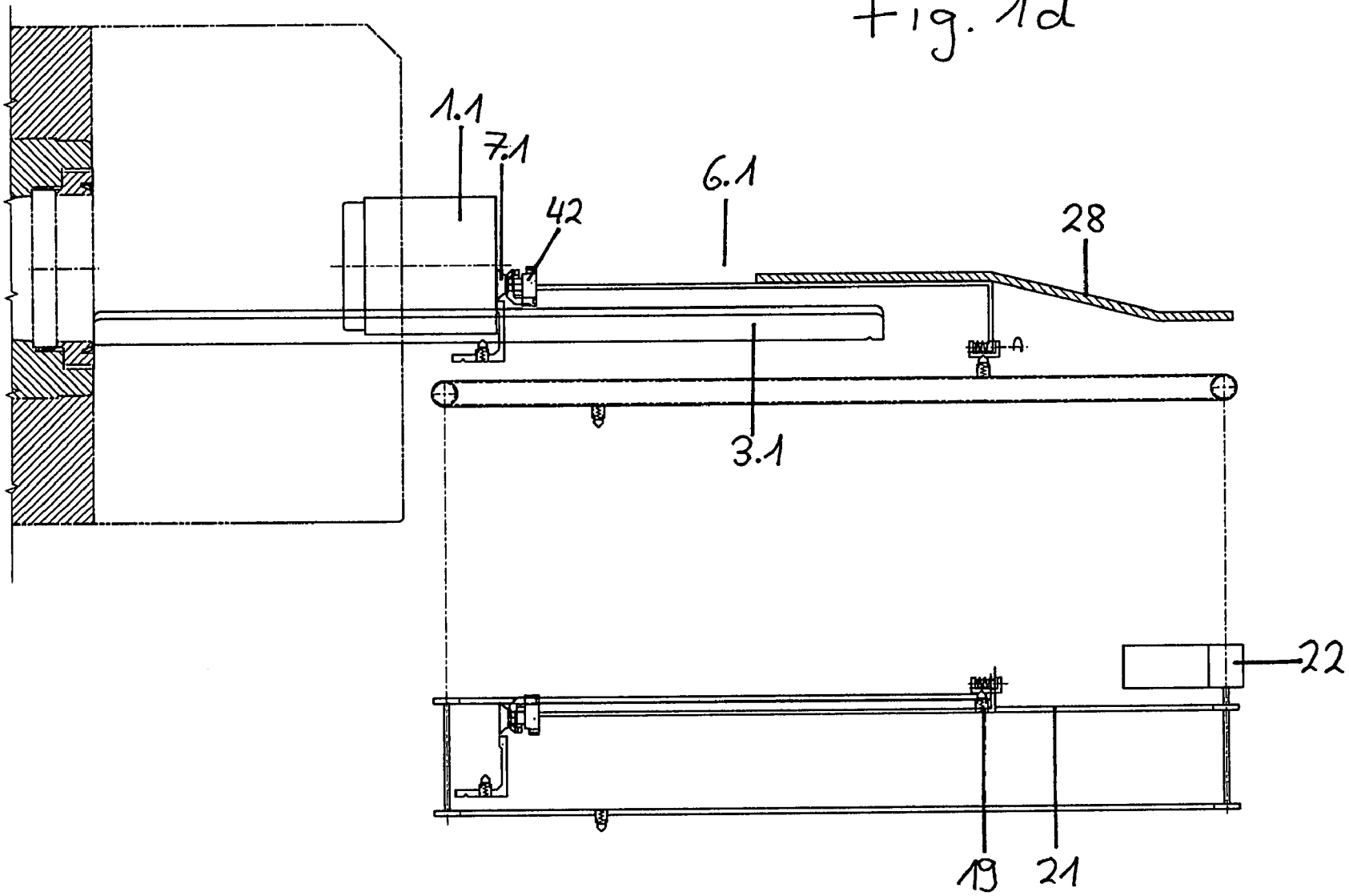
FIG. 1*d* shows the propellant charge feed means according to FIGS. 1*a* through 1*c* in a position in which the introduction stroke begins.
Figure 1E:
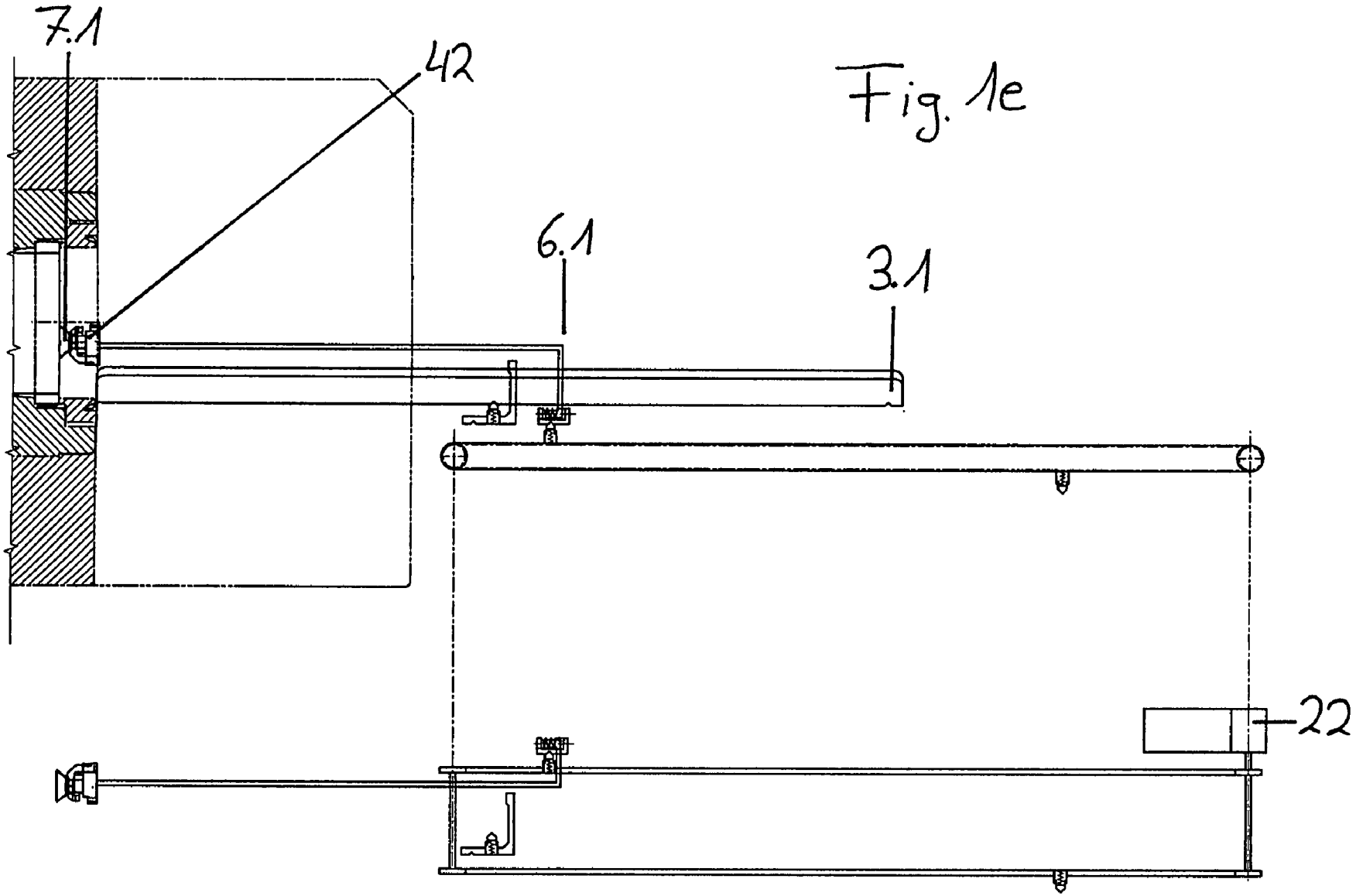
FIG. 1*e* shows the propellant charge feed means according to FIGS. 1*a* through 1*d* in a position after the introduction stroke has been performed.

The rotational drive 22 continues to drive the chains 20 and 21 and the arresting parts 18 and 19. The engagement element 18, however, disengages from the engagement element 25 and moves along with the chain 20. Therefore, the propellant charge 1.1 and the carrier 17 are temporarily not moved any further. The pivotable propellant charge advancing means 6.1, on the other hand, is moved towards the breech assembly 5.1 via the arresting part 19, which has engaged into the engagement element 43. During that movement, the guide rail 28 forces the propellant charge advancing means 6.1 to pivot into a position behind the propellant charge 1.1. After the propellant charge advancing means 6.1 has been pivoted into a position behind the propellant charge 1.1, the suction cup 7.1 of the propellant charge advancing means 6.1 reaches the propellant charge 1.1, onto which the suction cup 7.1 can couple by means of suction. That position is represented in FIG. 1*d*. Via the arresting part 19 and the chain 21, the rotational drive 22 continues to drive the propellant charge advancing means 6.1, which, together with the propellant charge 1.1, now moves towards the propellant charge chamber 4.1. Subsequently, the propellant charge 1.1 is pushed off of the propellant charge feed tray 3.1 and moved into the propellant charge chamber 4.1. That represents the introduction stroke. As soon as the propellant charge 1.1 has reached the intended introduction position behind the base ring 2.1, the suction cup 7.1 is aerated by an aerating means 42. That state is represented in FIG. 1*e*.

Ultimately, the rotational drive 22 turns in the opposite direction, whereby both the propellant charge advancing means 6.1 and the propellant charge feed tray 3.1 are returned to their initial position. In a particularly advantageous embodiment, the rotational drive can be configured as a drive with changeable parameters, thereby realizing the advantages described above.

Figure 2A:
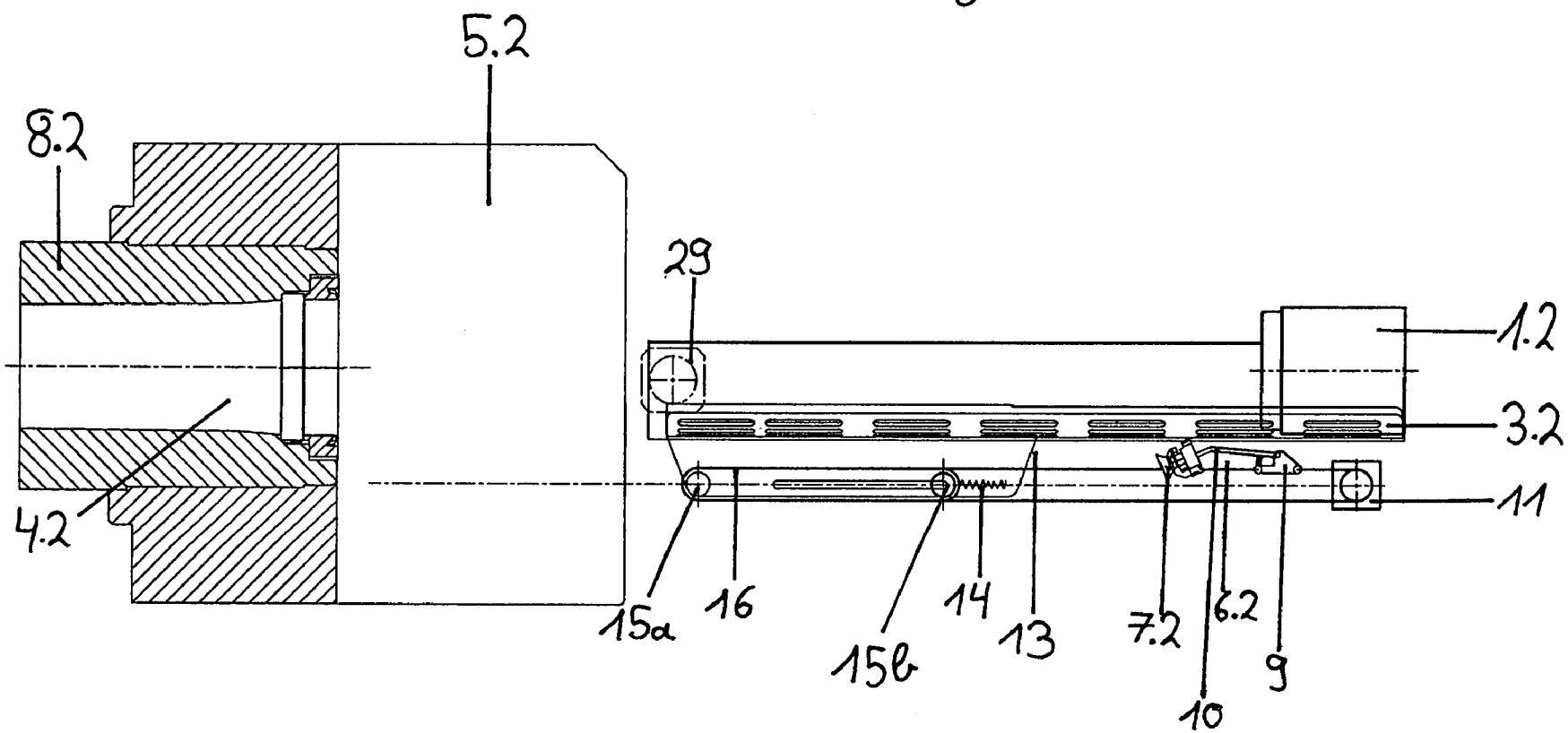
FIG. 2*a* shows a second embodiment of a propellant charge feed means in a position before the feed stroke is being performed.
Figure 2B:
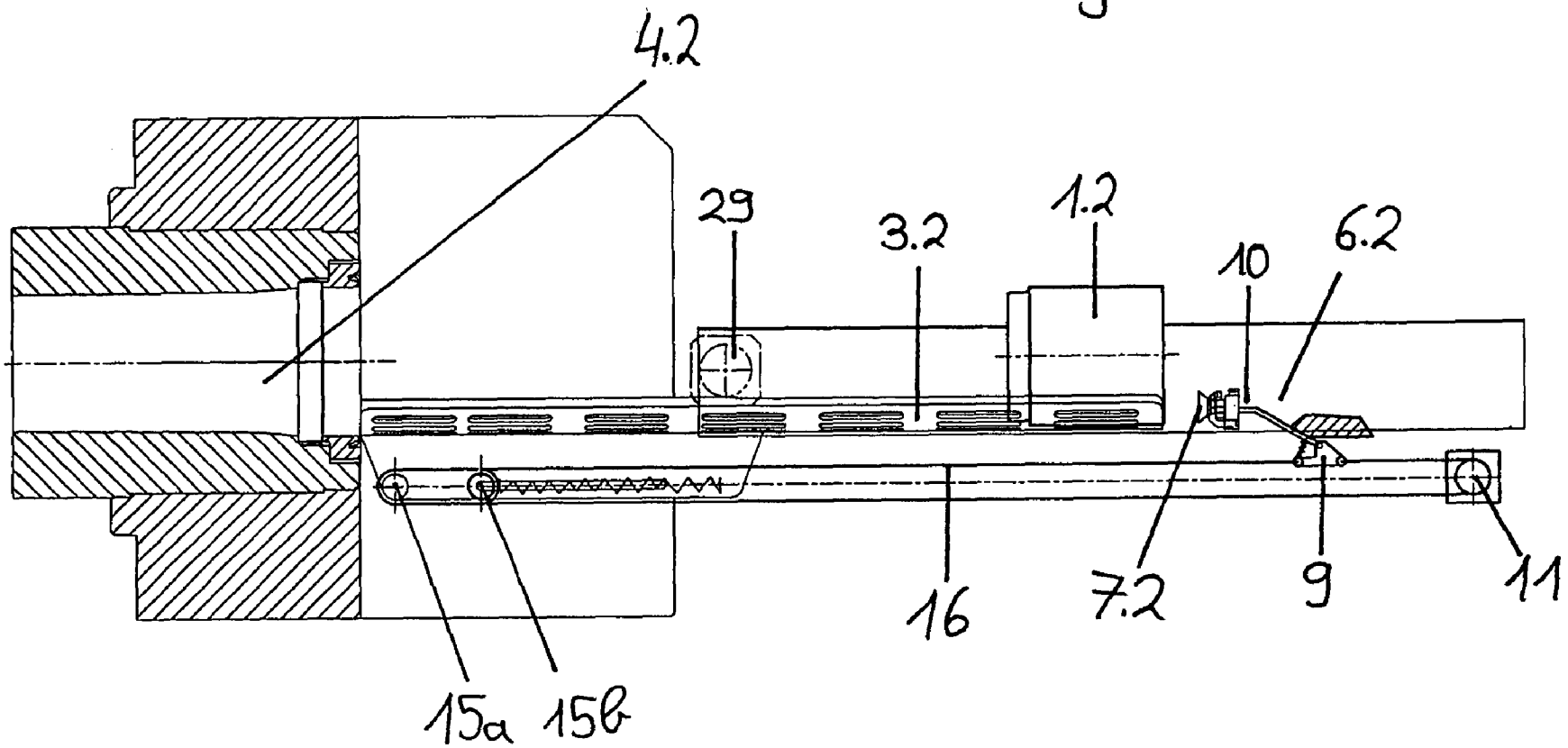
FIG. 2*b* shows the propellant charge feed means according to FIG. 2*a* in a position after the feed stroke has been performed and before the introduction stroke is performed.
Figure 2C:
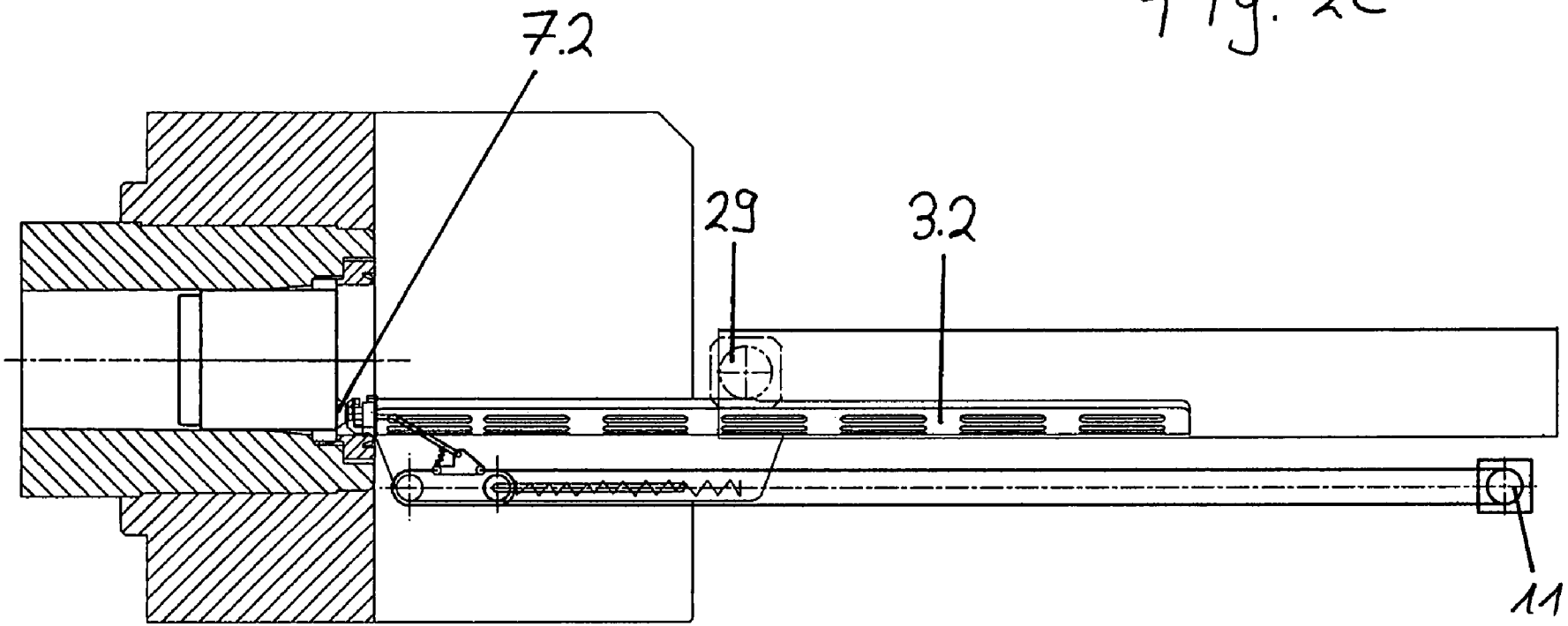
FIG. 2*c* shows the propellant charge feed means according to FIGS. 2*a* and 2*b* in a position after the introduction stroke has been performed.

FIGS. 2*a*-2*c* show a second embodiment of the propellant charge feed means. In FIGS. 2*a*-2*c,* only one propellant charge 1.2 is represented exemplary for a propellant charge module that is comprised of several individual propellant charges. The propellant charge 1.2 is located on a propellant charge feed tray 3.2, which is pivoted into a position behind the weapon tube 8.2 in such a way that the propellant charge 1.2 is located coaxial in relation to the axis of the bore of the weapon tube 8.2. A propellant charge advancing means 6.2 in the resting position is located below the propellant charge feed tray 3.2. The propellant charge advancing means 6.2 comprises an introduction sled 9 and an elevating element 10 with a suction cup 7.2. The introduction sled 9 is connected to an endless cable pulling means that has a given length. The endless cable pulling means comprises a cable 16 and two cable pulleys 15*a* and 15*b* and is connected to a rotational drive 11. The cable pulleys 15*a,* 15*b* hereby serve as direction reversing or guide pulleys. The cable pulley 15*a,* which is located closer to the propellant charge chamber 4.2, is fixedly attached to the propellant charge feed tray 3.2 via a connection element 13. The other cable pulley 15*b* is connected to the connection element 13 via a spring 14.

During a feed stroke, the propellant charge feed tray 3.2 is moved, by means of a drive 29, through the breech assembly 5.2 until it reaches the propellant charge chamber 4.2 of the weapon tube 8.2. When the propellant charge feed tray 3.2 is moved, the cable pulley 15*a* is moved in the same manner due to the connection element 13. Furthermore, the cable pulley 15*b* is moved by means of the cable 16, yet not to the same extent as the connection element 13 and the cable pulley 15*a*. Hence, the spring that is connected to the cable pulley 15*b* is tensioned. This configuration serves to compensate for the length, which is necessary since the rotational drive 11 is stationary.

FIG. 2*b* shows the propellant charge feed means after the feed stroke has been realized. The propellant charge feed tray 3.2 has been moved through the breech assembly until reaching the propellant charge chamber 4.2. Furthermore, it is at this time no longer located above the propellant charge advancing means 6.2. The propellant charge advancing means 6.2 changes from the resting position to the introduction position whereby the elevating element 10 swivels upwards in such a way that it comes to be located behind the propellant charge 1.2.

Subsequently, the rotational drive 11 moves the introduction sled 9 via the cable 16 and the cable pulleys 15*a,* 15*b* so that the propellant charge advancing means 6.2 is moved towards the propellant charge chamber 4.2. Thereby, the propellant charge advancing means 6.2 makes contact with the propellant charge 1.2 via the suction cup 7.2, which couples to the propellant charge 1.2 by means of suction. The propellant charge advancing means 6.2 is moved until the propellant charge 1.2 is located in the intended position in the propellant charge chamber 4.2, whereupon the introduction stroke is terminated. That position is represented in FIG. 2*c*. The suction cup 7.2 is aerated and the propellant charge advancing means 6.2 is drawn back. Hereupon, the propellant charge feed tray 3.2 is moved backwards through the breech assembly 5.2 into the initial position by means of the drive 29. In a particularly advantageous configuration, the drawing back of the propellant charge feed tray 3.2 and of the propellant charge advancing means 6.2 is realized simultaneously. In this embodiment, the drives 29 and 11 can also be configured with changeable parameters so that the aforementioned advantages can be realized.

FIGS. 3*a*-3*g* show a third embodiment of the propellant charge feed means. In this example, the propellant charges 1.3 are combined to a rod of propellant charges that is comprised of six individual propellant charges 1.3.

The propellant charges 1.3 are located on a propellant charge feed tray 3.3. They are to be moved through the breech assembly 5.3 into the propellant charge chamber 4.3 of the weapon tube 8.3 behind the base ring 2.3.

Figure 3A:
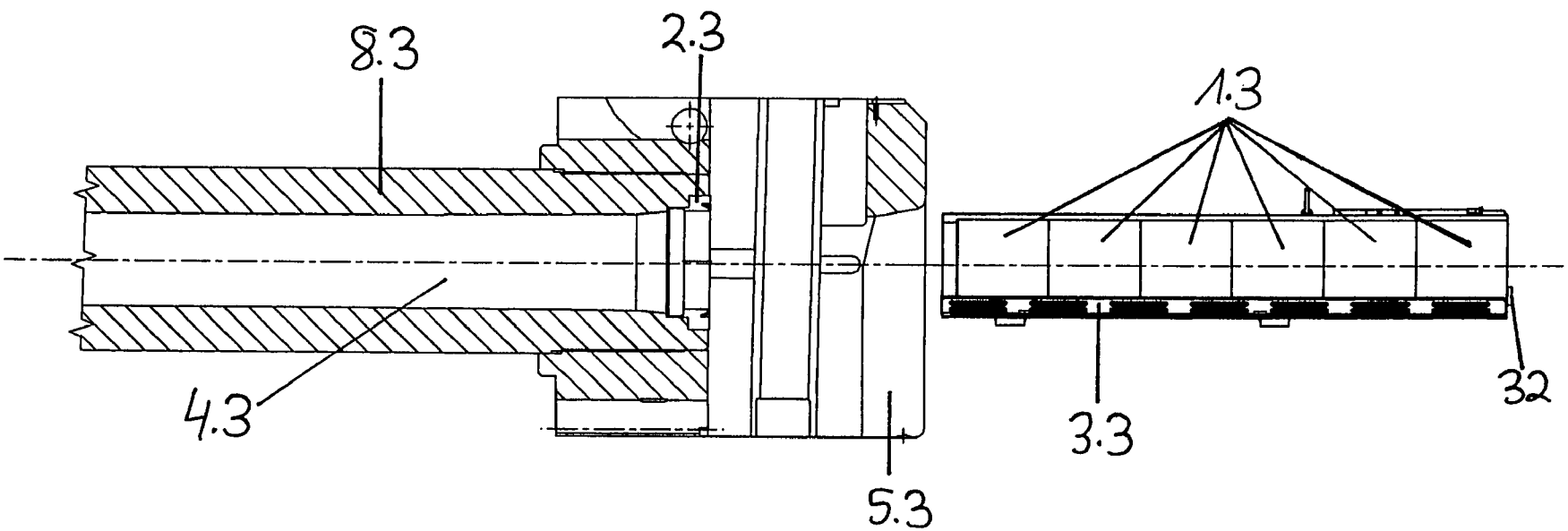
FIG. 3*a* shows a third embodiment of a propellant charge feed means in a position before the feed stroke is being performed.
Figure 3B:
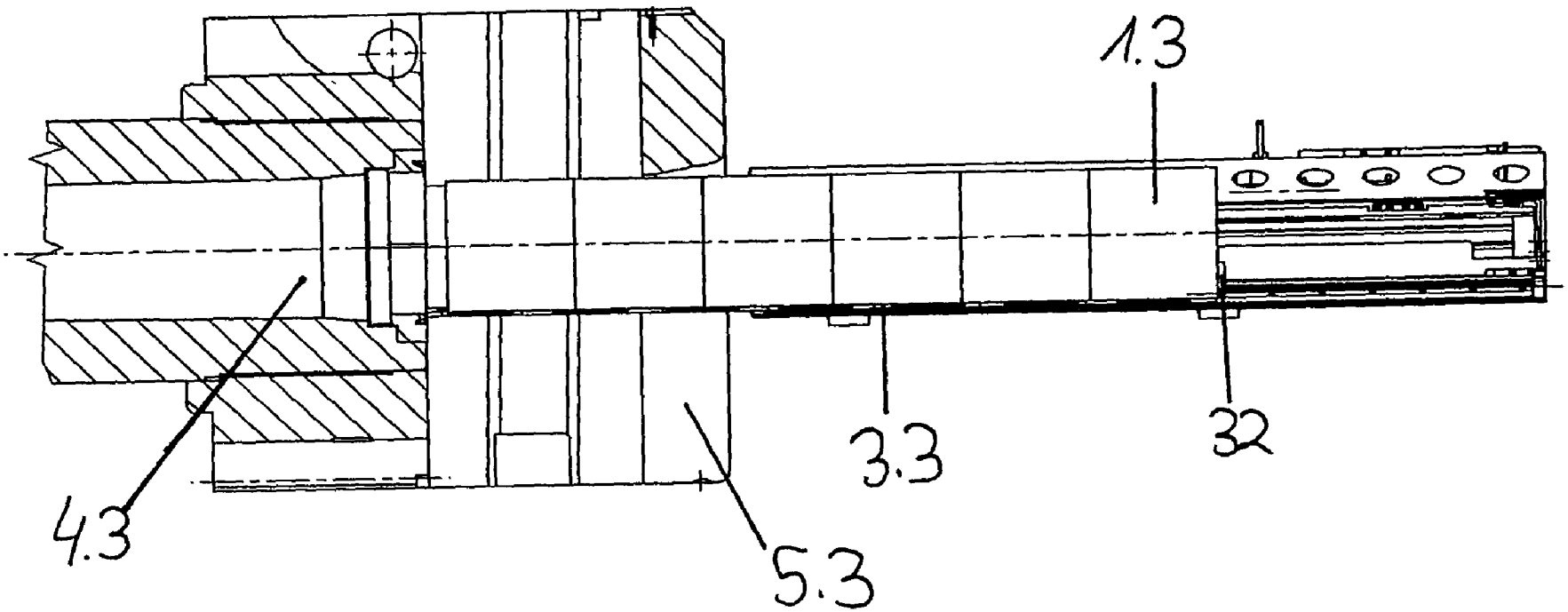
FIG. 3*b* shows the propellant charge feed means according to FIG. 3*a* in a position after the feed stroke has been performed and before the introduction stroke is performed.
Figure 3C:
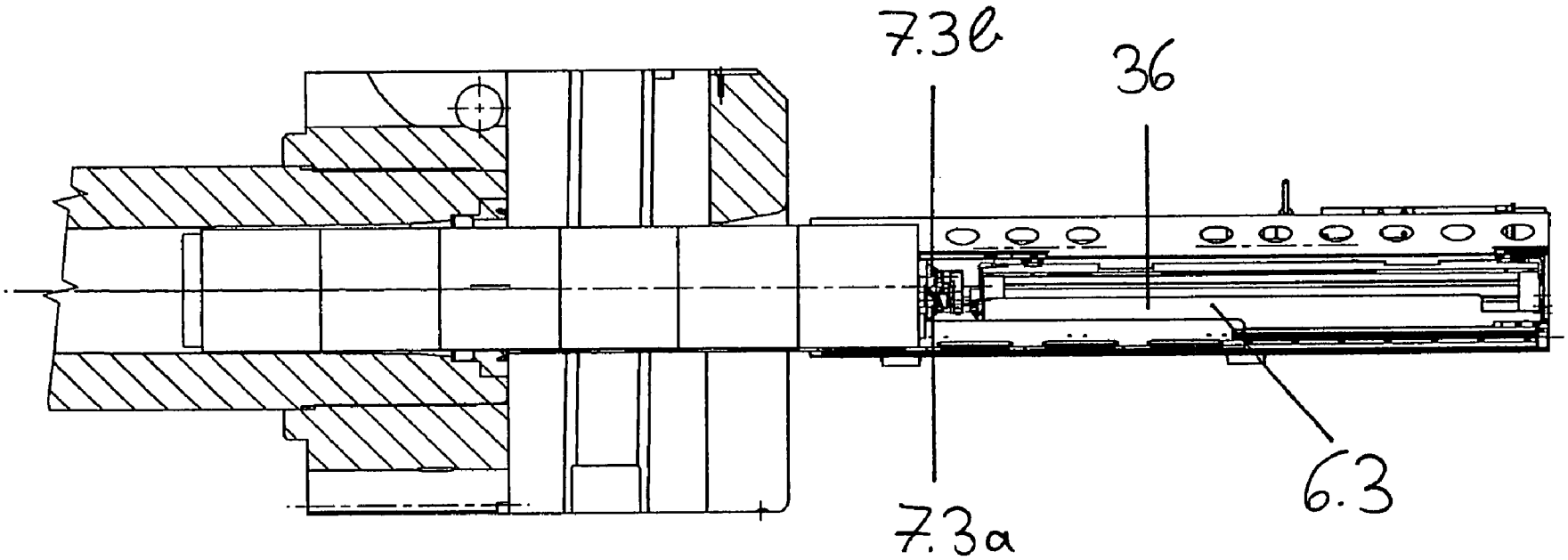
FIG. 3*c* shows the propellant charge feed means according to FIGS. 3*a* and 3*b* in a position in which the introduction stroke is being prepared.
Figure 3D:
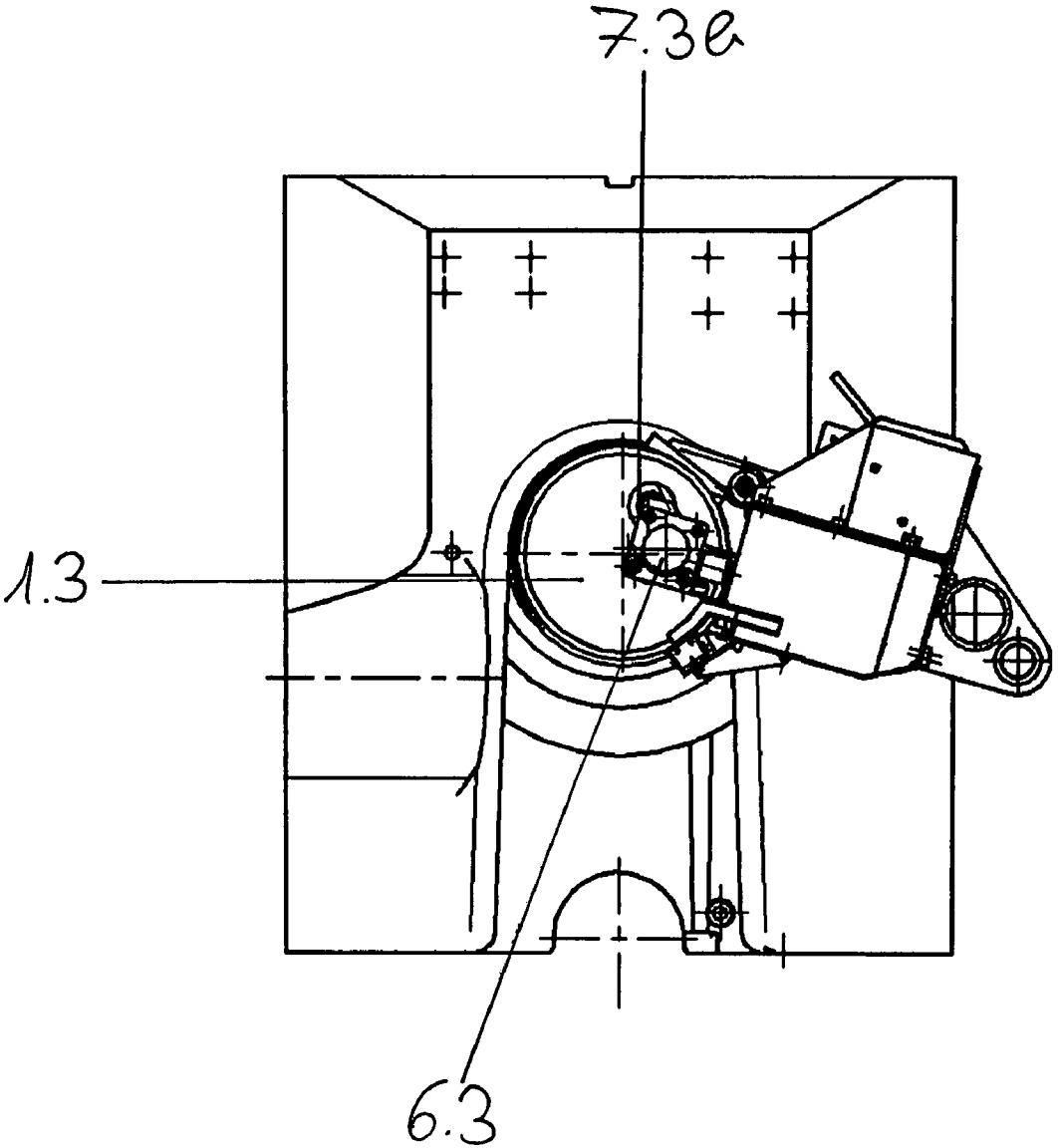
FIG. 3*d* shows the propellant charge feed means according to FIGS. 3*a* through 3*c* in a view rotated by 90°.
Figure 3E:
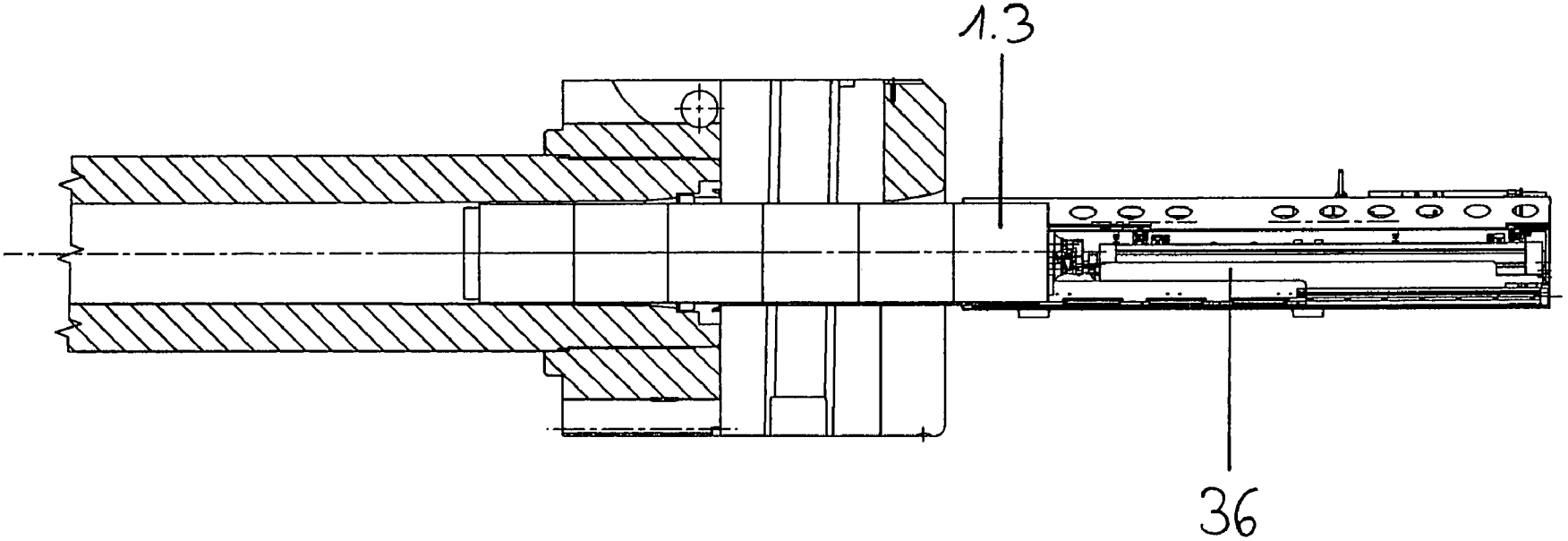
FIG. 3*e* shows the propellant charge feed means according to FIGS. 3*a* through 3*d* in a position in which the introduction stroke begins.
Figure 38:
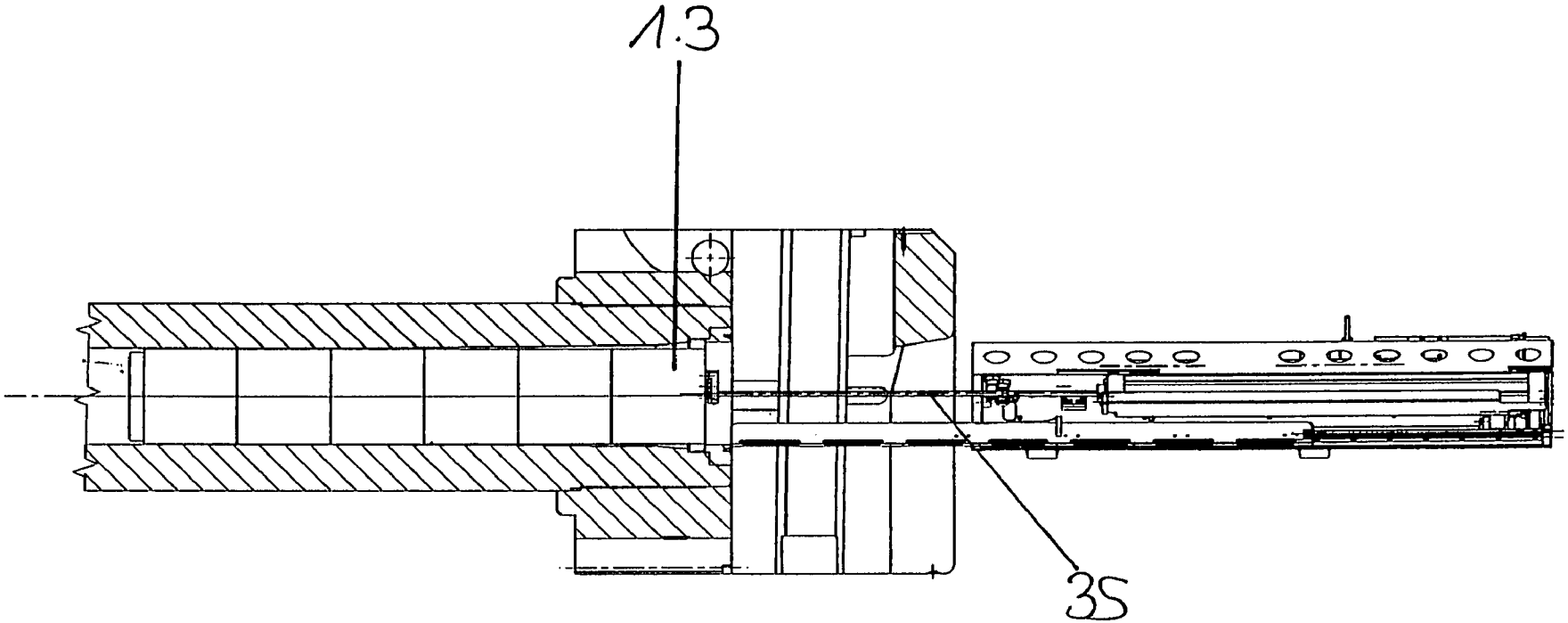
Figure 3G:
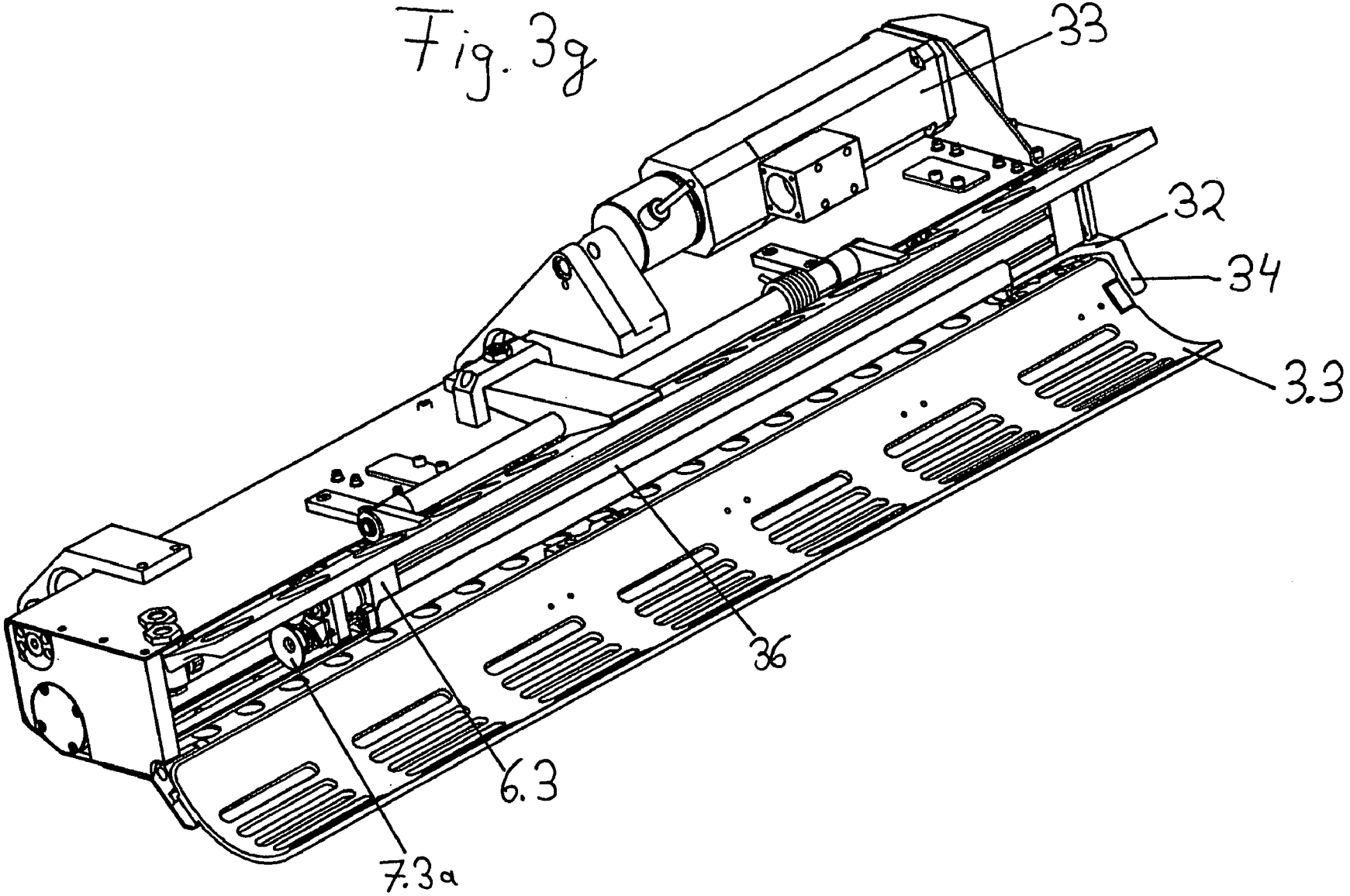
FIG. 3*g* shows a portion of the propellant charge feed means according to FIGS. 3*a* through 3*f* in an isometric representation.

For that reason, the propellant charge feed means has a drive 33 that is represented in FIG. 3*g*. Via a not represented linear spindle, the drive 33 moves a carrier 32, which is connected to the linear spindle by means of a not represented spindle nut. Furthermore, the carrier 32 has a carrier finger 34 and a not represented arresting part that engages into a not represented engagement element in the propellant charge feed tray 3.3. Hence, the drive 33 can move the propellant charge feed tray 3.3 via the linear spindle and the carrier 32.

The propellant charge feed tray 3.3 is moved trough the breech assembly 5.3 until it abuts against the propellant charge chamber 4.3. The feed stroke is thereby realized. That state is represented in FIG. 3*b*.

The drive 33 continues to drive the carrier 32 via the linear spindle. The arresting part of the carrier 32 thereby disengages from the engagement element of the propellant charge feed tray 3.3. The propellant charges 1.3 are moved further along by the carrier finger 34. That state is represented in FIG. 3*c*.

Located behind the propellant charge feed tray 3.3 is a propellant charge advancing means 6.3, which comprises a pneumatic cylinder 36, two suction cups 7.3*a* and 7.3*b* and an introduction bar 35 that is represented in FIG. 3*f*. When the propellant charge feed means is located in the position represented in FIG. 3*c*, the propellant charge advancing means 6.3 has sufficient space to change from the resting position to the introduction position. With the aid of compression springs that are not represented and via two not represented linear guide means, the propellant charge advancing means 6.3 is thereby brought behind the propellant charges 1.3. The propellant charge feed means with a propellant charge advancing means 6.3 that is released in the aforementioned manner is represented in FIGS. 3*d* and 3*e*. Subsequently, the pneumatic cylinder 36 pushes the propellant charges 1.3 into the propellant charge chamber 4.3 by means of the introduction bar 35 and the suction cups 7.3*a* and 7.3*b*, which are coupled to the propellant charges 1.3 by means of suction. That represents the introduction stroke. As soon as the propellant charge 1.3 has reached the intended introduction position behind the base ring 2.3, the suction cups 7.3*a* and 7.3*b* are aerated. That state is represented in FIG. 3*f*.

Ultimately, the propellant charge advancing means 6.3 and the propellant charge feed tray 3.3 are returned to the initial position. In an advantageous manner, the propellant charge advancing means 6.3 and the propellant charge feed tray 3.3 are simultaneously returned to the initial position whereby the sequence is expedited.

In a particularly advantageous embodiment, the drive 33 can be configured as a drive with changeable parameters, thereby realizing the aforementioned advantages.

Figure 4A:
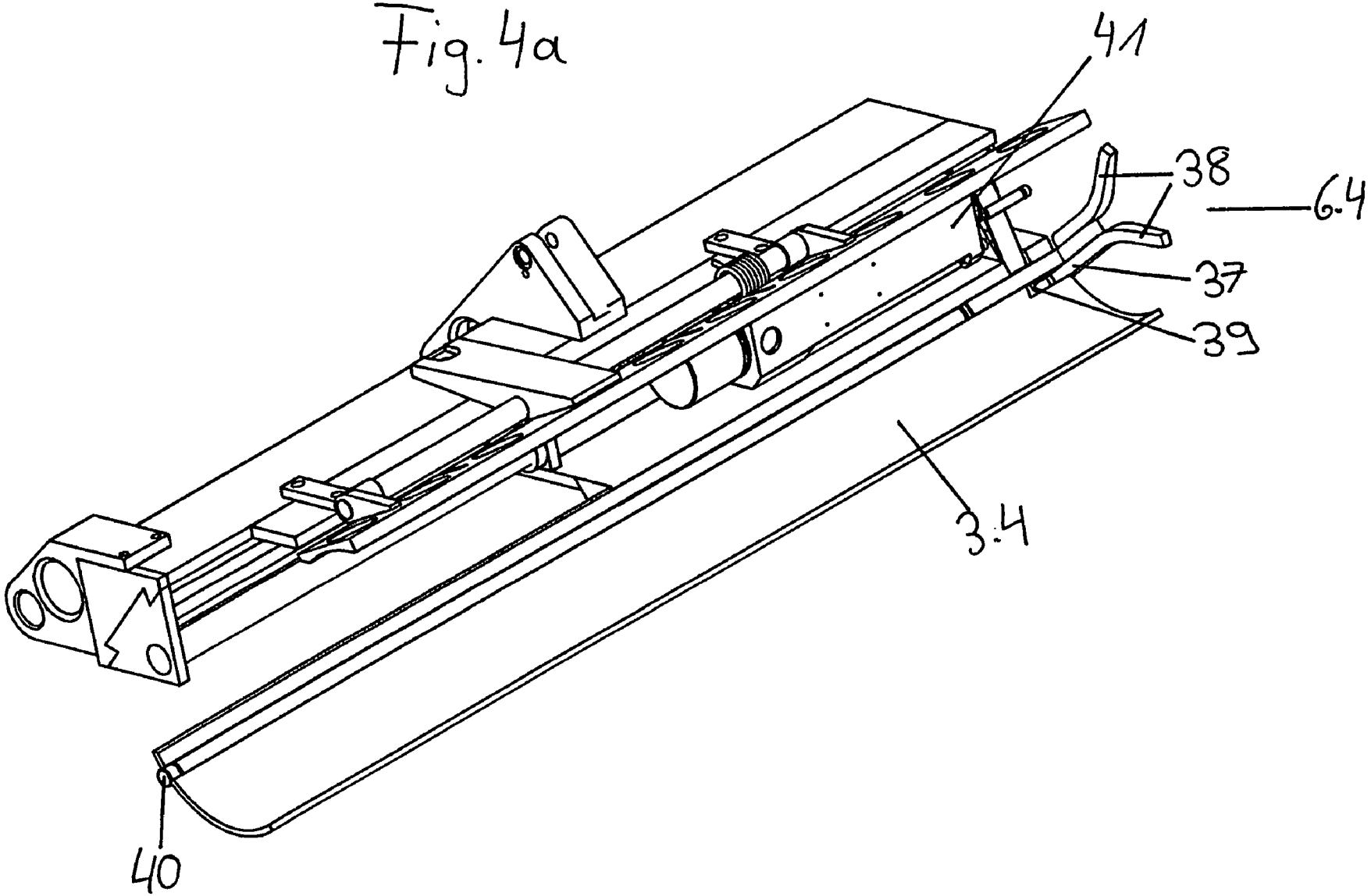
FIG. 4*a* shows a fourth embodiment of a propellant charge feed means in a position before the feed stroke is performed.

FIG. 4*a* shows a fourth embodiment of the propellant charge feed means. This embodiment is similar to the third embodiment represented in FIGS. 3*a* through 3*g*. Hence, only differences between the third and the fourth embodiment will be explained.

FIG. 4*a* essentially shows the propellant charge feed tray 3.4 and the propellant charge advancing means 6.4. In the third embodiment, the propellant charge advancing means 6.3 is comprised of a pneumatic cylinder 36, an introduction bar 35 and the suction cups 7.3*a* and 7.3*b*. The propellant charge feed tray 3.3 is moved via a carrier 32, and the propellant charges 1.3 on the propellant charge feed tray 3.3 are moved along with it.

The main difference is that the propellant charge advancing means 6.4 is comprised of a drive 41, a linear spindle 40 and a carrier arm 37, which has two carrier fingers 38. The carrier arm 37 is pivotable and connected to the linear spindle 40 via a not represented spindle nut. The carrier arm 37 has the function of both the carrier 32 and the introduction bar 35 in the third embodiment. In the initial position, the carrier arm 37 is located in a guide groove 39 of the propellant charge feed tray 3.4. The guide groove 39, however, does not extend over the entire length of the propellant charge feed tray 3.4. After the propellant charge feed tray 3.4 has been moved to the propellant charge chamber, the carrier arm 37 is moved towards the propellant charge chamber via the drive 41. Initially, the carrier arm 37 travels through the guide groove 39 and thereby extends almost perpendicularly in relation to the propellant charge feed tray 3.4. When the carrier arm 37 leaves the guide slot 39, it is automatically pivoted towards the direction of the propellant charge chamber. In that position, only the carrier fingers 38 of the carrier arm 37 touch the propellant charges. Hence, the propellant charge advancing means 6.4 has changed from the resting position to the introduction position.

The carrier arm 37 is moved over the entire length of the propellant charge feed tray 3.4, thereby introducing the propellant charges into the intended introduction position in the propellant charge chamber. Subsequently, the propellant charge advancing means 6.4 and the propellant charge feed tray 3.4 are returned—in an advantageous way simultaneously—to the initial position.

FIGS. 5*a*-5*e* show a fifth embodiment of the propellant charge feed means. The representations of this configuration are similar to the first embodiment, which is shown in FIGS. 1*a* through 1*e*. Analogous to FIGS. 1*a* through 1*e*, the view VA shows the propellant charge feed means in a side view; the view VB is a top plan view.

Figure 5A:
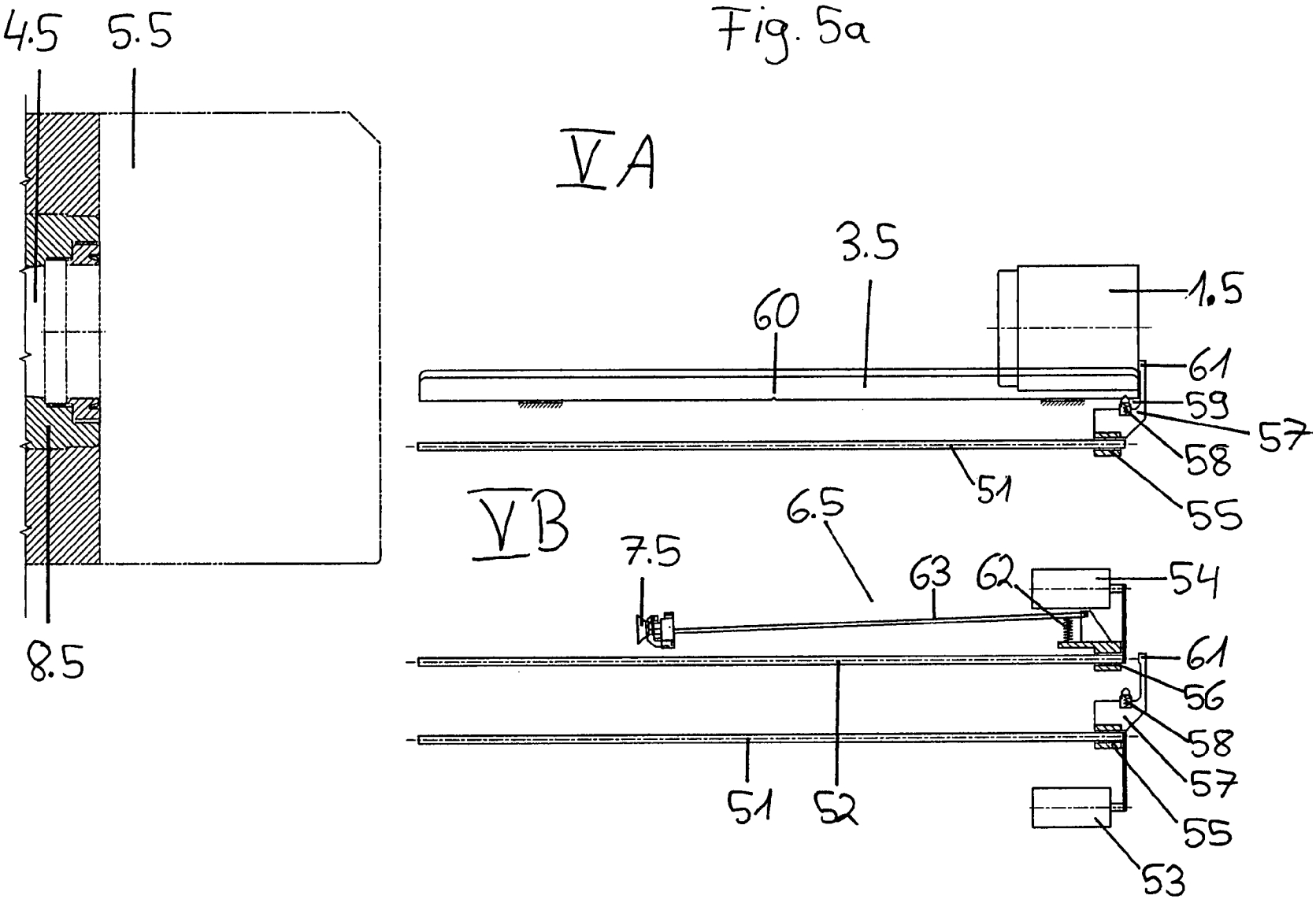
FIG. 5*a* shows a fifth embodiment of a propellant charge feed means in a position before the feed stroke is performed.

One main difference between the fifth embodiment and the first embodiment is that the drive for the movement of the carrier 17 and the propellant charge advancing means 6.1, as represented in FIG. 1*a*, is not realized by means of a rotational drive 22 via chains 20 and 21, but, as represented in FIG. 5*a*, by means of two linear spindles 51 and 52, whereby the linear spindle 51 is driven by a drive 53 and the linear spindle 52 is driven by a drive 54.

A spindle nut 55, which is connected to a carrier 57, is arranged on the linear spindle 51. In addition to a carrier finger 61, the carrier 57 has an arresting part 58 that engages into an engagement element 59 located on the propellant charge feed tray 3.5.

A spindle nut 56, which is connected to a propellant charge advancing means 6.5, is arranged on the linear spindle 52. The propellant charge advancing means 6.5 has a suction cup 7.5, a spring 62 and an introduction bar 63.

Figure 5B:
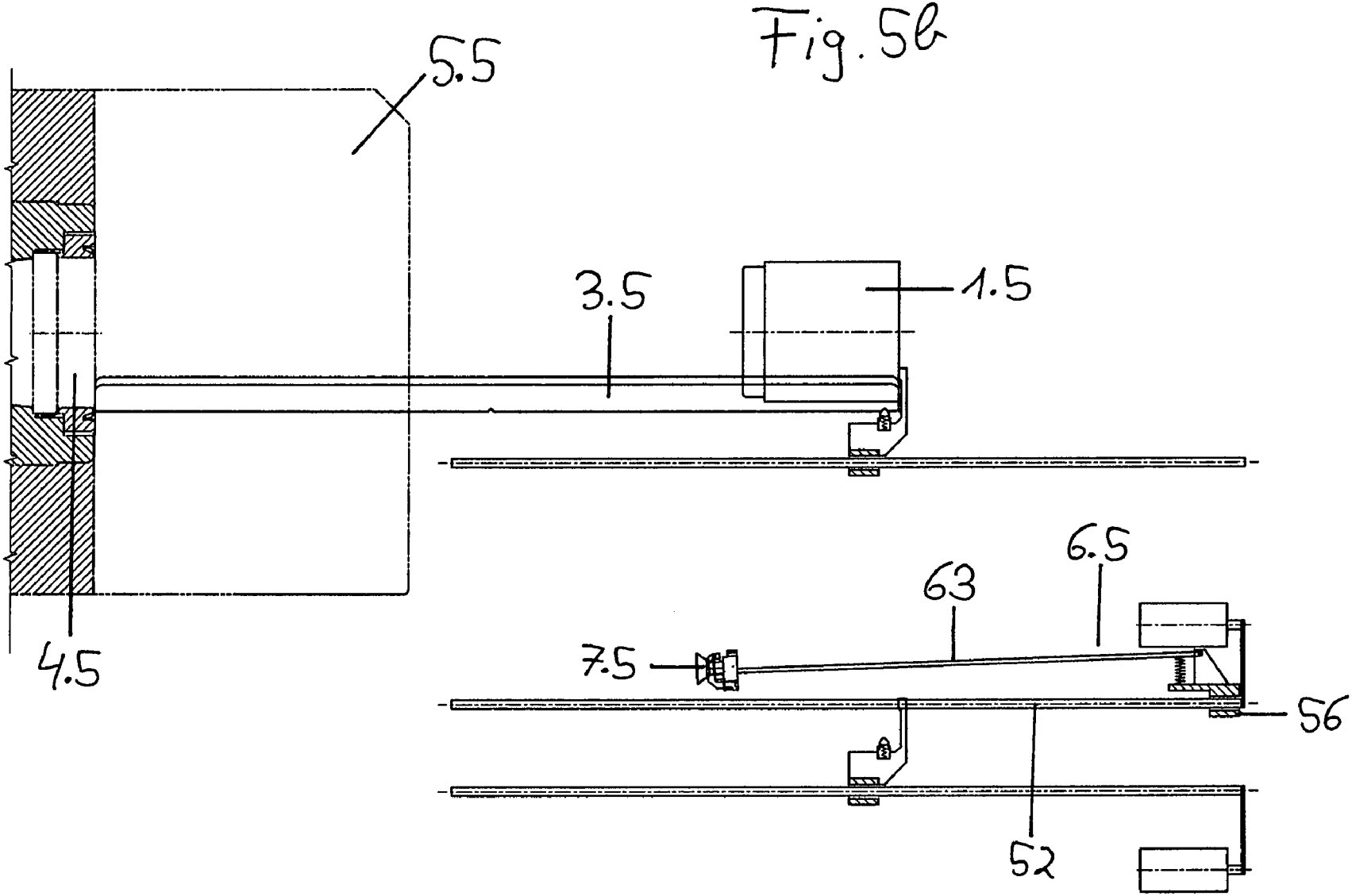
FIG. 5*b* shows the propellant charge feed means according to FIG. 5*a* in a position after the feed stroke has been performed and before the introduction stroke is performed.

When the linear spindle 51 is driven by the drive 53, the motion is transferred to the propellant charge feed tray 3.5 via the spindle nut 55, the carrier 57, the arresting part 58 and the engagement element 59. In this manner, the propellant charge feed tray 3.5 is moved towards the breech assembly 5.5 until it abuts against the propellant charge chamber 4.5. FIG. 5*b* shows the propellant charge feed means after the feed stroke has been performed.

Figure 5C:
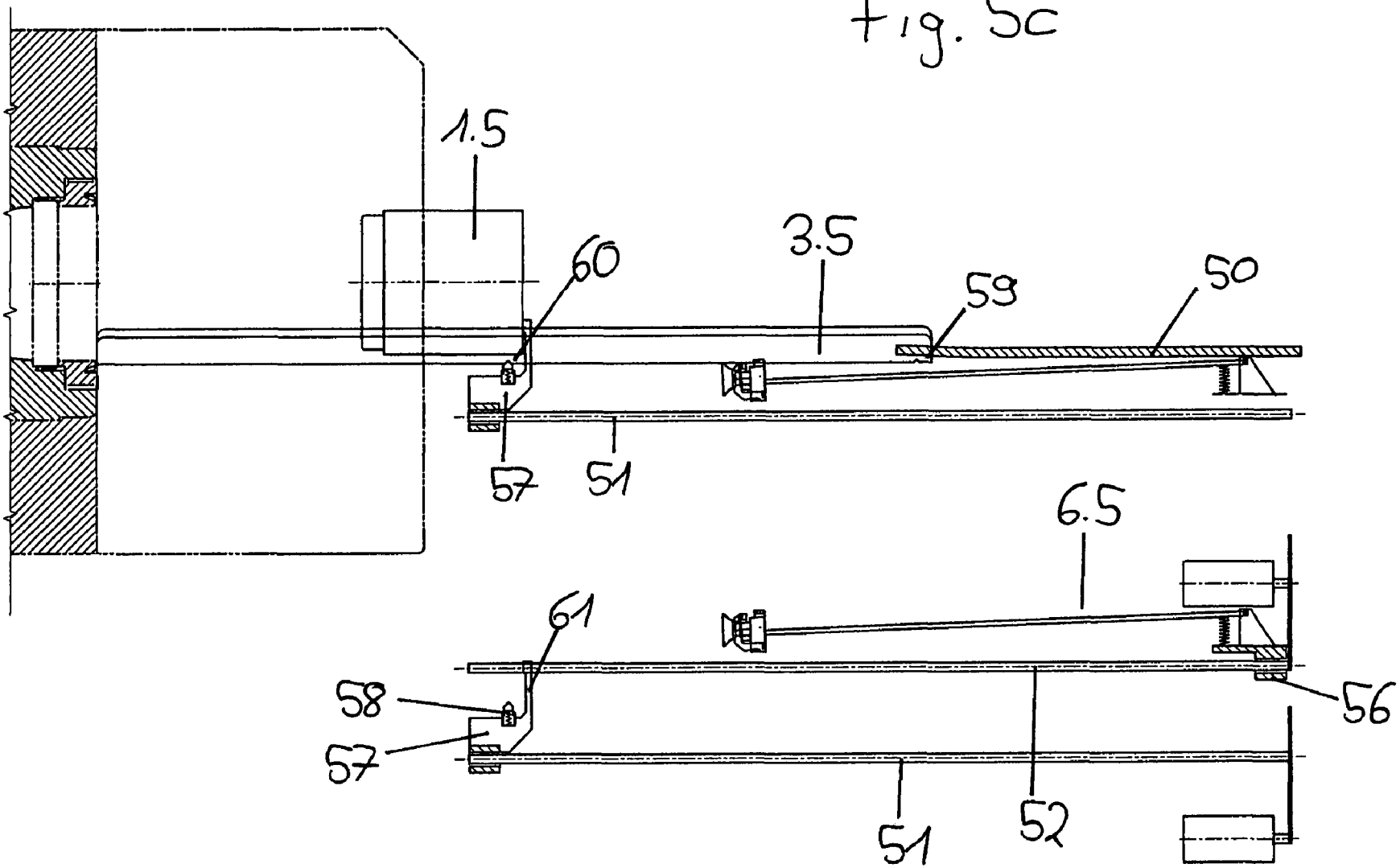
FIG. 5*c* shows the propellant charge feed means according to FIGS. 5*a* and 5*b* in a position in which the introduction stroke is being prepared.

If the linear spindle 51 continues to be driven, the arresting part 58 disengages from the engagement element 59, and the carrier 57, via the carrier finger 61, pushes the propellant charge 1.5 towards the propellant charge chamber 4.5 until the arresting part 58 engages into the engagement element 60 on the propellant charge feed tray 3.5. That state is represented in FIG. 5*c*.

Subsequently, the propellant charge advancing means 6.5 is moved towards the propellant charge chamber 4.5 by the drive 54 via the linear spindle 52 and the spindle nut 56. The propellant charge advancing means 6.5 is guided along a linear guide means 50, whereby it is swiveled upwards.

Figure 5D:
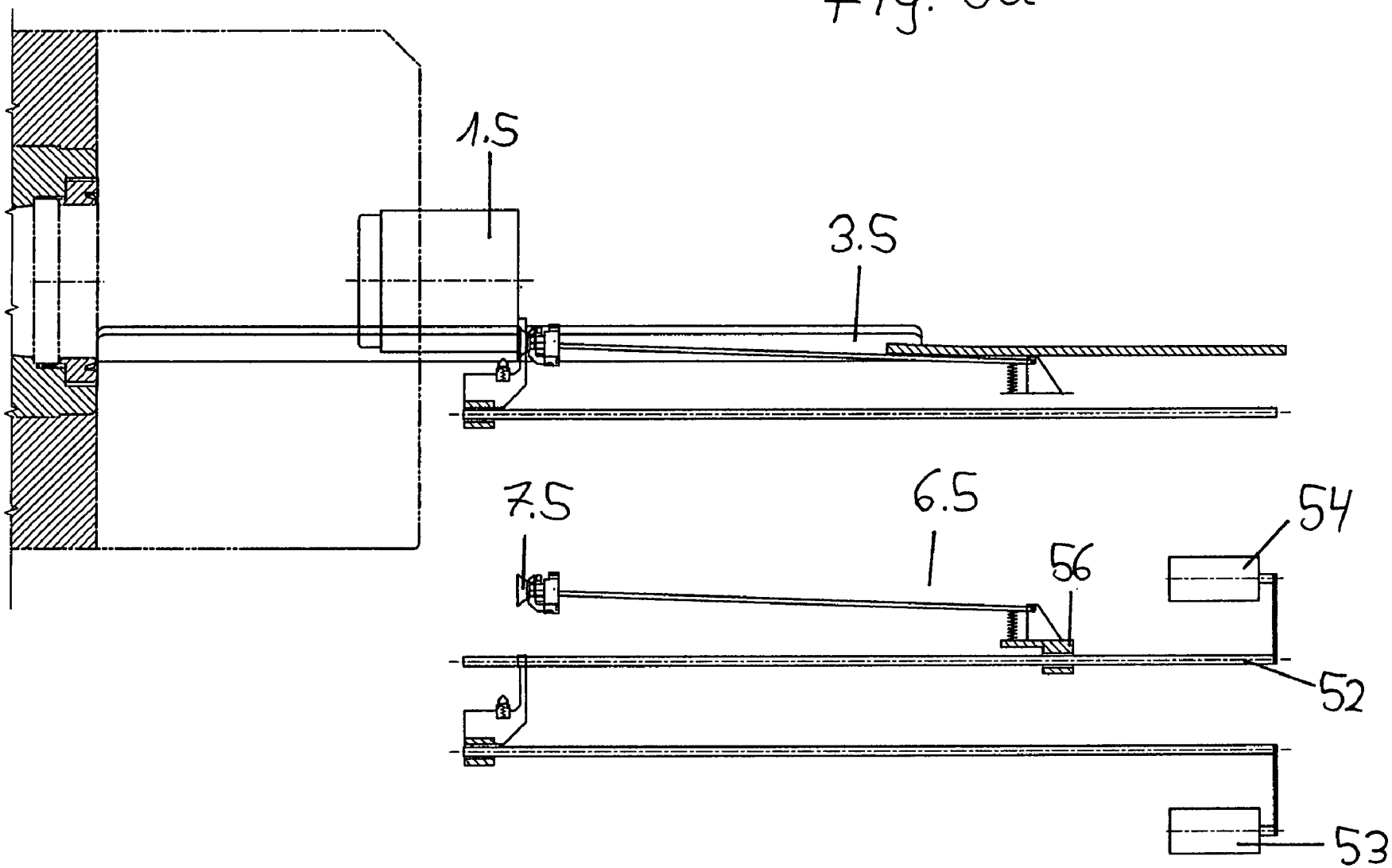
FIG. 5*d* shows the propellant charge feed means according to FIGS. 5*a* through 5*c* in a position in which the introduction stroke begins.

The propellant charge advancing means 6.5 is moved towards the propellant charge chamber 4.5 until it reaches the propellant charge 1.5. At this time, the suction cup 7.5 couples to the propellant charge 1.5 by means of suction. That state is represented in FIG. 5*d*.

Figure 5E:
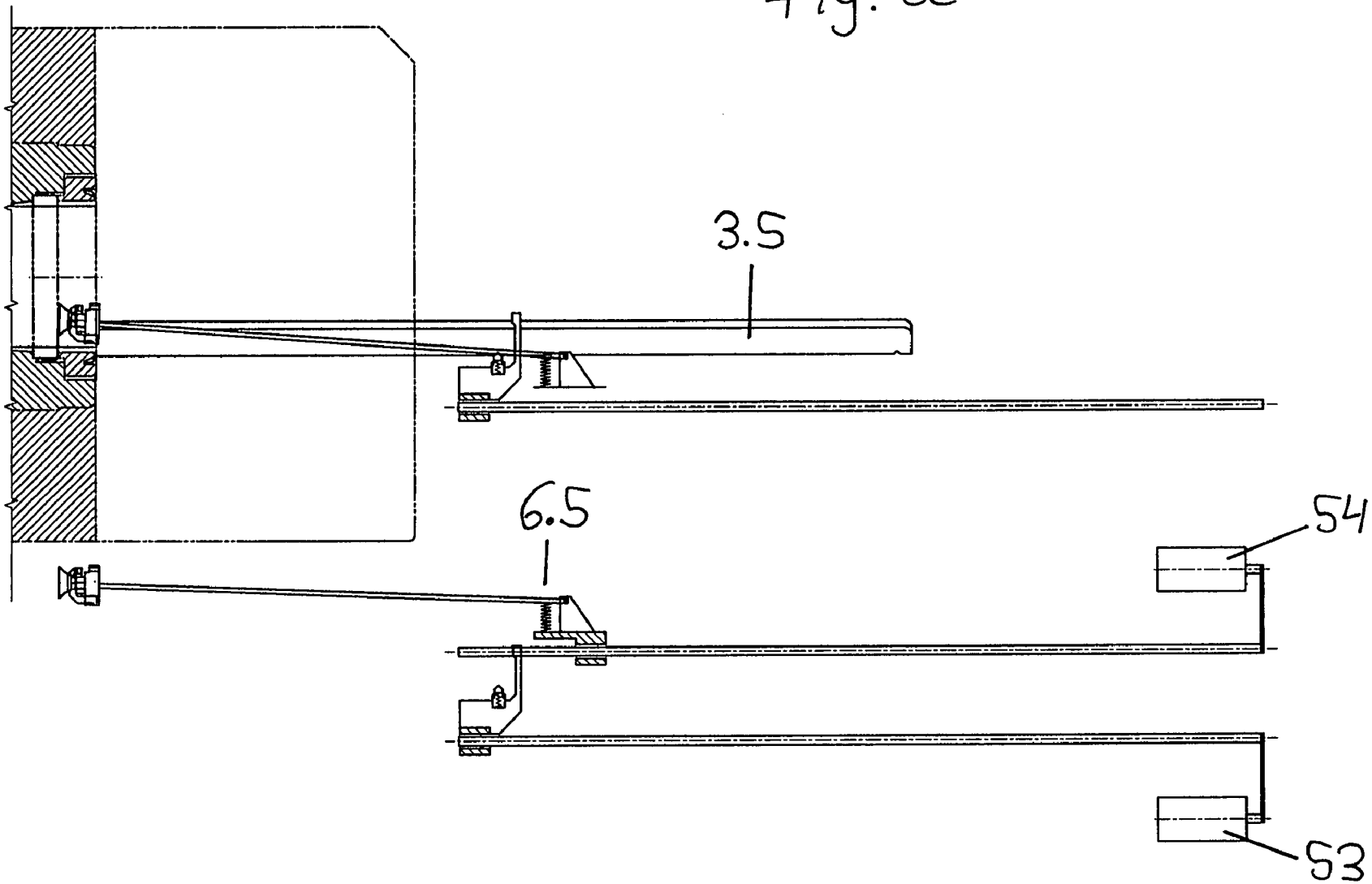
FIG. 5*e* shows the propellant charge feed means according to FIGS. 5*a* through 5*d* in a position after the introduction stroke has been performed.

The drive 54 continues to drive the propellant charge advancing means 6.5, which, together with the propellant charge 1.5, moves towards the propellant charge chamber 4.5. Thereafter, the propellant charge 1.5 is moved away from the propellant charge feed tray 3.5 into the propellant charge chamber 4.5. That represents the introduction stroke. As soon as the propellant charge 1.5 has reached the intended position in the propellant charge chamber 4.5, the suction cup 7.5 is aerated. That state is represented in FIG. 5*e*.

Subsequently, the drive 54 first turns in the opposite direction, whereby the propellant charge advancing means 6.5 is returned to the initial position. Then, the drive 53 turns in the opposite direction as well, whereby the propellant charge feed tray 3.5 is likewise returned to the initial position. In an advantageous way, both drives 54 and 53 can simultaneously realize the returning of the propellant charge advancing means 6.5 and the propellant charge feed tray 3.5, whereby the sequence is expedited.

In a particularly advantageous embodiment, the drives 54 and 53 can again be configured with changeable parameters, thus realizing the advantages described above.

Figure 6A:
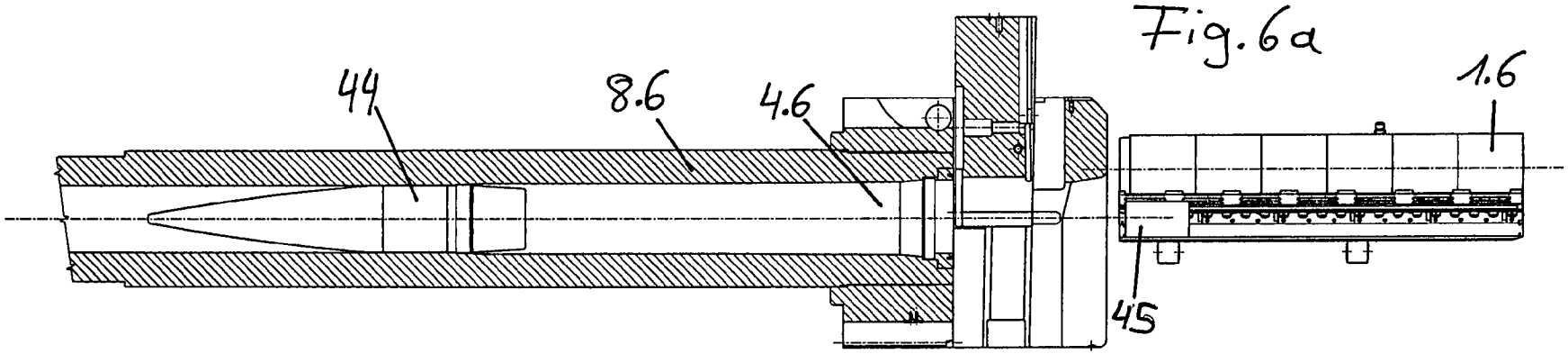
FIG. 6*a* shows a propellant charge feed means with a sensor in a position before the feed stroke is performed.
Figure 6B:
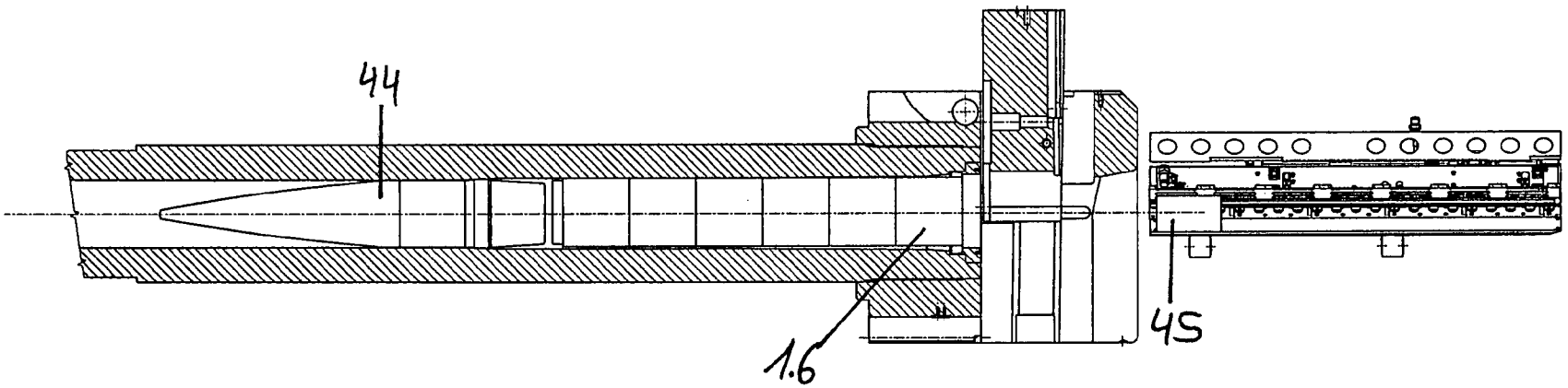
FIG. 6*b* shows a propellant charge feed means with a sensor in a position after the introduction stroke has been performed.

FIGS. 6*a* and 6*b* show a propellant charge feed means that has a sensor 45. FIG. 6*a* shows a position before the feed stroke is performed. A projectile 44 is already located in the weapon tube 8.6. The sensor 45 emits laser rays by means of which the correct position of the projectile can be verified.

FIG. 6*b* shows a position after the introduction stroke has been performed. The propellant charges 1.6 are now located in the propellant charge chamber 4.6. Again, the sensor 45 emits laser rays by means of which the correct position of the propellant charges 1.6 can be verified.

The specification incorporates by reference the disclosure of German priority document 10 2005 029 413.8 filed Jun. 24, 2005.

The present invention is, of course, in no way restricted to the specific disclosure of the specification and drawings, but also encompasses any modifications within the scope of the appended claims.

The invention claimed is:

1. A method of operating a propellant charge feed means for automatic introduction of modular propellant charges into a weapon tube of a heavy weapon having a breech assembly and a propellant charge chamber, including the steps of:

loading a projectile into said weapon tube;

pivoting a propellant charge feed tray into a position behind the weapon tube in such a way that propellant charges disposed on said feed tray are disposed coaxial relative to the axis of the bore of the weapon tube;

during a feed stroke, moving said feed tray, via a providing means, into the breech assembly until the propellant charge chamber is reached, wherein during said feed stroke, the propellant charges are disposed on said feed tray; and during an introduction stroke, moving the propellant charges, via an introduction means, from said feed tray into the propellant charge chamber, wherein a propellant charge advancing means, in an introduction position, is disposed behind the propellant charges in such a way that it can apply a force onto the propellant charges that acts in the axial direction of said feed tray and in a direction toward the propellant charge chamber, wherein said advancing means is adapted to change from a resting position to an introduction position, and wherein in the resting position, the propellant charge advancing means is not disposed behind the propellant charges.

2. A method according to claim 1, wherein said introduction stroke is realized by introduction means, and is initiated at the same time or after said feed stroke, which is realized by said providing means.

3. A method according to claim 2, wherein said introduction stroke is initiated only after conclusion of said feed stroke.

4. A method according to claim 1, wherein said change of said advancing means from a resting position into the introduction position is realized by means of at least one pretensioned spring.

5. A method according to claim 1, wherein said change of said advancing means from the resting position into the introduction position is effected only after initiation of movement brought about by said providing means.

6. A method according to claims 1, wherein at the conclusion of said feed stroke, a portion of said advancing means that couples to the propellant charges is introduced into the weapon tube in such a way that the propellant charges are disposed in the propellant charge chamber behind a base ring.

7. A method according to claim 1, wherein aerating means aerate suction cups disposed on said advancing means and coupled to the propellant charges by means of suction only after the propellant charges have reached the intended introduction position in the propellant charge chamber.

8. A method according to claims 1, wherein said propellant charge feed means is removed entirely from the breech assembly after the propellant charges have been introduced into the propellant charge chamber.

9. A method according to claim 1, wherein said advancing means changes from said introduction position to said resting position when said propellant charge feed means moves out of the propellant charge chamber.

10. A method according to claim 1, wherein a speed of said advancing means is adapted to increase at a beginning of feed motion of the propellant charges and to decrease at a conclusion of said feed motion.

11. A method according to one of the claims 1, wherein the modular propellant charges are adapted to be combined to form a propellant rod prior to introducing the propellant charges into said propellant charge chamber.

12. A method according to claim 1, wherein at least one sensor is provided to verify if a projectile is disposed in an intended position in the weapon tube prior to introducing the propellant charges.

13. A method according to claim 12, wherein laser beams or ultrasound is used to sense the position of the projectile.

14. A method according to claim 1, wherein at least one sensor is provided to verify, after introduction of the propellant charges, if the propellant charges are disposed in the intended introduction position in the propellant chamber.

15. A method according to claims 14, wherein laser beams or ultrasound is used for sensing the introduction position of the propellant charges.

* * * * *